US011170712B2

(12) United States Patent
Imai et al.

(10) Patent No.: US 11,170,712 B2
(45) **Date of Patent: *Nov. 9, 2021**

(54) DISPLAY DEVICE FOR ADJUSTING BLACK INSERTION FOR REDUCING POWER CONSUMPTION

(71) Applicant: JAPAN DISPLAY INC., Tokyo (JP)

(72) Inventors: Takayuki Imai, Tokyo (JP); Norio Nakamura, Tokyo (JP)

(73) Assignee: JAPAN DISPLAY INC., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/376,095

(22) Filed: Apr. 5, 2019

(65) Prior Publication Data

US 2019/0237015 A1 Aug. 1, 2019

Related U.S. Application Data

(63) Continuation of application No. 15/635,333, filed on Jun. 28, 2017, now Pat. No. 10,304,382, which is a (Continued)

(30) Foreign Application Priority Data

Jul. 31, 2014 (JP) ..... 2014-156648

(51) Int. Cl.
*G09G 3/3233* (2016.01)
*G09G 3/3283* (2016.01)
*G09G 5/18* (2006.01)

(52) U.S. Cl.
CPC ..... *G09G 3/3233* (2013.01); *G09G 3/3283* (2013.01); *G09G 5/18* (2013.01); (Continued)

(58) Field of Classification Search
CPC ..... G09G 3/3233
(Continued)

(56) References Cited

U.S. PATENT DOCUMENTS 7,701,448 B2 4/2010 Nakamura et al.
9,728,137 B2 8/2017 Imai
(Continued)

FOREIGN PATENT DOCUMENTS

JP 2008-89956 4/2008
JP 2011-002520 1/2011
(Continued)

OTHER PUBLICATIONS

Office Action dated Oct. 10, 2017 in Japanese Patent Application No. 2014-156648 (with English translation).

*Primary Examiner* — Long D Pham
(74) *Attorney, Agent, or Firm* — Oblon, McClelland, Maier & Neustadt, L.L.P.

(57) ABSTRACT

According to one embodiment, a display device includes a display panel in which pixel units are arranged, and a controller configured to generate image signals by multiplying display data externally supplied to each line by a luminosity adjustment factor, to supply the generated image signals to the pixel units, to accumulate power consumption of each line, and to execute black insertion if the accumulated power consumption is determined to be greater than power consumption of one previous display frame by a predetermined value, wherein the luminosity adjustment factor is acquired by substituting the power consumption of one previous frame to a decreasing function, and a display pattern including a plurality of continuing black display lines is synchronized with supply of the image signals and is displayed moving the same direction of a screen scanning direction of the display panel during the black insertion.

20 Claims, 13 Drawing Sheets

Related U.S. Application Data continuation of application No. 14/812,214, filed on Jul. 29, 2015, now Pat. No. 9,728,137.

(52) U.S. Cl.
CPC . *G09G 2310/08* (2013.01); *G09G 2320/0646* (2013.01); *G09G 2330/021* (2013.01); *G09G 2330/023* (2013.01)

(58) Field of Classification Search
USPC ..... 345/691
See application file for complete search history.

(56) References Cited

U.S. PATENT DOCUMENTS

2007/0030219 A1* 2/2007 Park ..... G09G 3/3233 345/76
2007/0103425 A1 5/2007 Tanaka
2007/0126672 A1 6/2007 Tada
2007/0182700 A1* 8/2007 Baba ..... G09G 3/20 345/102
2008/0001881 A1* 1/2008 Baba ..... G09G 3/3406 345/89
2008/0259235 A1* 10/2008 Chien ..... G09G 3/3648 349/39
2009/0174634 A1 7/2009 Kohno
2009/0284515 A1 11/2009 Tsuge
2010/0265228 A1* 10/2010 Kimura ..... G09G 3/3233 345/207
2010/0315444 A1 12/2010 Mori et al.
2013/0235013 A1 9/2013 Chiu

FOREIGN PATENT DOCUMENTS

JP 2013-29613 2/2013
JP 2014-26016 2/2014

* cited by examiner

DISPLAY DEVICE FOR ADJUSTING BLACK INSERTION FOR REDUCING POWER CONSUMPTION

CROSS-REFERENCE TO RELATED APPLICATIONS

This application is a continuation of U.S. application Ser. No. 15/635,333, filed Jun. 28, 2017, which is a continuation of U.S. application Ser. No. 14/812,214 filed Jul. 29, 2015, now U.S. Pat. No. 9,728,137, which is based upon and claims the benefit of priority from Japanese Patent Application No. 2014-156648, filed Jul. 31, 2014, the entire contents of each of which is incorporated herein by reference.

FIELD

Embodiments described herein relate generally to a display device.

BACKGROUND

In recent years, the demand for flat-panel display devices such as a liquid crystal display device has rapidly grown because of the thinness, lightness, and energy-efficiency of such devices. Amongst others, an active-matrix display device is adopted in various devices including mobile information devices. The active-matrix display device includes on-state pixels and off-state pixels those are electrically separated and a pixel switch functioning to hold an image signal on the on-state pixel in each pixel.

As such a flat-panel active-matrix display device, an organic electroluminescent (EL) display device using self-luminescent elements is now the focus of keen research and development. The organic EL display device does not require a backlight, and is suitable for both movie playing use because of its rapid response and cold environmental use because of its luminosity which does not decrease even at a low temperature.

As to the electronic devices such as a mobile information device, there has been a great need for reduction of power consumption. An electronic device including a display device is considered, large power is used for driving the display device, and thus, reduction of the power consumption for driving the display device is required.

In general, the power consumption in the display device such as an organic EL element increases when the luminosity of the display screen increases. In order to reduce the power consumption in the display device, a luminosity control circuit is provided therewith.

DETAILED DESCRIPTION

Figure 1:
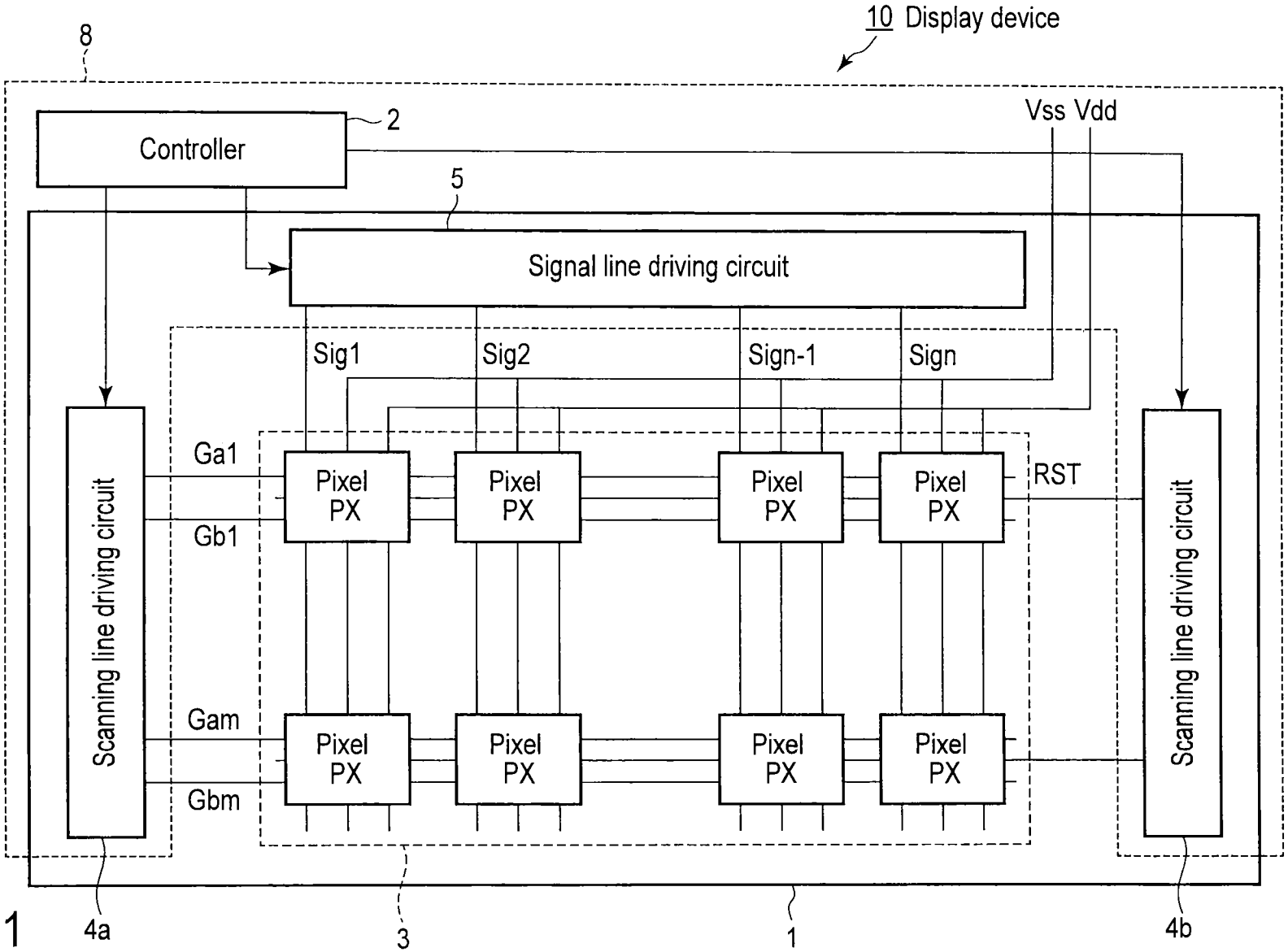
FIG. 1 is an exemplary plan view which schematically shows a display device of the first embodiment.

Various embodiments will be described hereinafter with reference to the accompanying drawings.

If a luminosity adjustment function is performed automatically to reduce the power consumption, display quality may deteriorate. For example, there is a luminosity adjustment function to detect a sudden luminosity increase between a previous frame and a current frame and to suppress the luminosity for power consumption reduction. In this function, luminosity of a next frame is suppressed based on the luminosity of the current frame, and thus, the luminosity of the current frame becomes greater than the luminosity of the previous frame and the luminosity of the next frame. This would cause a flash phenomenon by which the display screen flashes for an instant. To prevent the flash phenomenon, there is a luminosity adjustment method in which frames are stored in a frame memory to adjust the luminosity of each frame before display data writing is performed, and by this method, a sudden luminosity change in a display image can be prevented.

In general, according to one embodiment, a display device includes a pixel unit including a light emission element and a pixel circuit which supplies current to the light emission element; a display panel in which the pixel units are arranged in a matrix on a substrate; and a controller configured to generate image signals for a display target frame by multiplying display data externally supplied to each line by a luminosity adjustment factor, to supply the generated image signals to the pixel units, to accumulate power consumption of each line, and to execute black insertion if the accumulated power consumption is determined to be greater than power consumption of one previous display frame by a predetermined value, wherein the luminosity adjustment factor is a positive real number which is less than or equal to one and is acquired by substituting the power consumption of one previous frame calculated using the entire display data externally supplied to a decreasing function, and a display pattern including a plurality of continuing black display lines is synchronized with supply of the image signals and is displayed moving the same direction of a screen scanning direction of the display panel during the black insertion.

Hereinafter, embodiments are described with reference to the accompanying drawings.

Note that the disclosure herein is for the sake of exemplification, and any modification and variation conceived within the scope and spirit of the invention by a person having ordinary skill in the art are naturally encompassed in the scope of invention of the present application. Furthermore, a width, thickness, shape, and the like of each element are depicted schematically in the Figures for the sake of simpler explanation as compared to actual embodiments, and they are not to limit the interpretation of the invention of the present application. Furthermore, in the description and Figures of the present application, structural elements having the same or similar functions will be referred to by the same reference numbers and detailed explanations of them that are considered redundant may be omitted.

First Embodiment

FIG. 1 is an exemplary plan view which schematically shows a display device 10 of the first embodiment. As shown in FIG. 1, the display device 10 comprises an organic EL panel 1 and a controller 2 configured to control the operation of the organic EL panel 1.

The organic EL panel 1 includes a display area 3, scanning line driving circuit 4*a*, scanning line driving circuit 4*b*, and signal line driving circuit 5.

The display area 3 includes an insulating substrate which exhibits light transmittance such as a glass plate, and m×n pixels PX arranged in a matrix on the insulating substrate. First scanning lines Ga (1 to m), second scanning lines Gb (1 to m), and reset power lines RST (1 to m) are arranged along the rows of the pixels PX, and each of them is connected to its corresponding pixel PX. Furthermore, image signal lines Sig (1 to n) are arranged along the columns of the pixels PX, and each of them is connected to its corresponding pixel PX in every column. Furthermore, high potential power line Vdd and low potential power line Vss are connected to each pixel PX.

Scanning line driving circuit 4*a* drives first scanning lines Ga (1 to m) and second scanning lines Gb (1 to m) in series in every row of the pixels PX. Scanning line driving circuit 4*b* outputs reset voltage VRST to reset power lines RST (1 to m). The signal line driving circuit 5 drives image signal lines Sig (1 to n). Scanning line driving circuits 4*a* and 4*b*, and signal line driving circuit 5 are formed integrally on the insulating substrate outside the display area, and constitute a control unit 8 with the controller 2.

In each row in the display area 3, three pixels PX displaying red (R), green (G), and blue (B), respectively are arranged in this order repeatedly.

Figure 2:
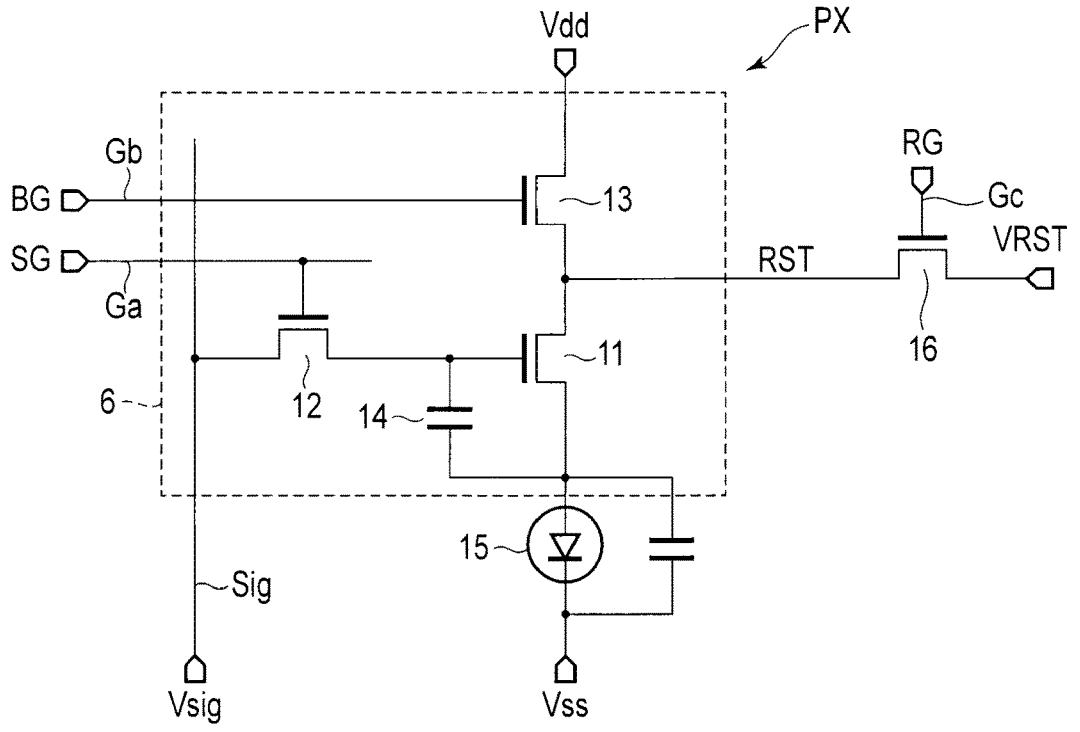
FIG. 2 is an exemplary view which shows an equivalent circuit of a pixel of the display device of the first embodiment.

FIG. 2 is an exemplary view which shows an equivalent circuit of the pixel PX of the display device 10 of the first embodiment. Each pixel PX functioning as a pixel unit includes an organic EL element 15 which is an self-luminous element and a pixel circuit 6 which supplies driving current to the organic EL element 15.

The pixel circuit 6 in the pixel PX shown in FIG. 2 is a voltage signal type pixel circuit which controls light emission of the organic EL element 15 corresponding to image signals composed of voltage signals. The pixel circuit 6 includes a driving transistor 11, pixel switch 12, output switch 13, and retaining capacitor 14. Furthermore, the pixel circuit 6 is connected to the reset power lines RST to which the reset voltage VRST is output from a reset switch 16 provided in scanning line driving circuit 4*b*.

In the display device 10 of the first embodiment, the driving transistor 11, pixel switch 12, and output switch 13 are each composed of a thin film transistor (TFT) of the same conductivity, namely, an N channel TFT, for example. Furthermore, the thin film transistors used for the driving transistor 11 and the switches are formed through the same process with the same layer structure, and may be a top-gate type thin film transistor of which semiconductor layer is formed of IGZO, a-Si, or polysilicon. Note that each of the transistor and switch is not limited to an N channel TFT, and may be a P channel TFT.

Each of the driving transistor 11, pixel switch 12, output switch 13, and reset switch 16 includes a first terminal, second terminal, and control terminal. Hereinafter, the first terminal, second terminal, and control terminal will occasionally be referred to as source, drain, and gate, respectively.

As to the pixel circuit 6 of the pixel PX used for green (G) display, for example, the driving transistor 11 and the output switch 13 are connected in series to the organic EL element 15 between the high potential power line Vdd and the low potential power line Vss. The power line Vdd is set to a potential of 10V, for example, and the power line Vss is set to a potential of −4V, for example.

As to the output switch 13, the second terminal which is a drain is connected to the power line Vdd. The first terminal which is a source is connected to the reset power line RST and a second terminal of the driving transistor 11, which is a drain. The control terminal which is a gate is connected to the second scanning line Gb. With this connection, the output switch 13 is controlled to be on (conductive) or off (nonconductive) by control signals BG from the second scanning line Gb and the light emission time of the organic EL element 15 is controlled.

As to the driving transistor 11, the second terminal which is a drain is connected to a source of the output switch 13 and the reset power line RST. The first terminal which is a source is connected to one terminal of the organic EL element 15, which is an anode. A cathode of the organic EL element 15 is connected to the power line Vss. The driving transistor 11 outputs driving current to the organic EL element 15, and the amount of driving current corresponds to the image signals.

As to the pixel switch 12, the second terminal which is a drain is connected to the image signal line Sig. The first terminal which is a source is connected to a gate of the driving transistor 11. Gate of the pixel switch 12 is connected to the first scanning line Ga which functions as a signal write control gate line and is turned on or off by control signals SG from the first scanning line Ga. Then, the pixel switch 12 controls connection and disconnection between the pixel circuit 6 and the image signal line Sig in response to the control signals SG, and takes image voltage signals from the corresponding image signal line Sig into the pixel circuit 6.

The retaining capacitor 14 has two terminals facing each other and is connected between the gate and the source of the driving transistor 11. The retaining capacitor 14 retains a control potential between the gate and the source of the driving transistor 11 determined by the image signals.

The reset switch 16 is, in each row, provided with scanning line driving circuit 4*b* and is connected between the drain of the driving transistor 11 and a reset voltage source supplying the reset voltage VRST. A gate of the reset switch 16 is connected to a third scanning line Gc functioning as a reset control gate line. The reset switch 16 is controlled to be on (conductive) or off (nonconductive) by control signals RG from the third scanning line Gc and initializes a source potential of the driving transistor 11.

On the other hand, the controller 2 shown in FIG. 1 is formed on a printed circuit board arranged to be outside the organic EL panel 1 and controls scanning line driving circuits 4*a* and 4*b*, and the signal line driving circuit 5. The controller 2 receives digital image signals and initialization signals which are supplied externally and generates, based on the synchronization signals, vertical scan control signals which control vertical scan timing and horizontal scan control signals which control horizontal scan timing.

Then, the controller 2 supplies the vertical scan control signals and the horizontal scan control signals to scanning line driving circuits 4*a* and 4*b*, and the signal line driving circuit 5, and further supplies digital image signals and synchronization signals to the signal line driving circuit 5 synchronizing with the horizontal scan timing and the vertical scan timing.

Under the control of the horizontal scan control signals, the signal line driving circuit 5 converts the image signals sequentially obtained in each of the horizontal scan periods into analog format, and supplies gradation voltage signals Vsig of different gradations to image signals lines Sig (1 to n) in parallel, and the gradation voltage signals Vsig include a red image voltage signal, green image voltage signal, and blue image voltage signal corresponding to the obtained image signals. Furthermore, the signal line driving circuit 5 supplies initialization voltage signals to image signal lines Sig (1 to n) in parallel in every horizontal period.

Scanning line driving circuit 4*a* includes a shift register, an output buffer, and the like and sequentially transfers vertical scan start pulses which are supplied externally to subsequent rows. Scanning line driving circuit 4*a* supplies, as shown in FIGS. 1 and 2, two kinds of control signals, that is, SG (1 to m) and BG (1 to m) to the pixels PX in each row. Thereby, first scanning lines Ga (1 to m) and second scanning lines Gb (1 to m) are driven by the control signals SG (1 to m) and BG (1 to m).

Scanning line driving circuit 4*b* includes a reset switch 16, shift register, output buffer, and the like, sequentially transfers vertical scan start pulse which is supplied externally to subsequent rows, and generates control signals RG (1 to m). Scanning line driving circuit 4*b* controls the reset switch 16 by the generated control signals RG (1 to m) and supplies the reset voltage VRST to the pixels PX in each row through the reset power lines (1 to m).

Now, the operation of the display device 10 with the above-described structure will be explained.

Figure 3:
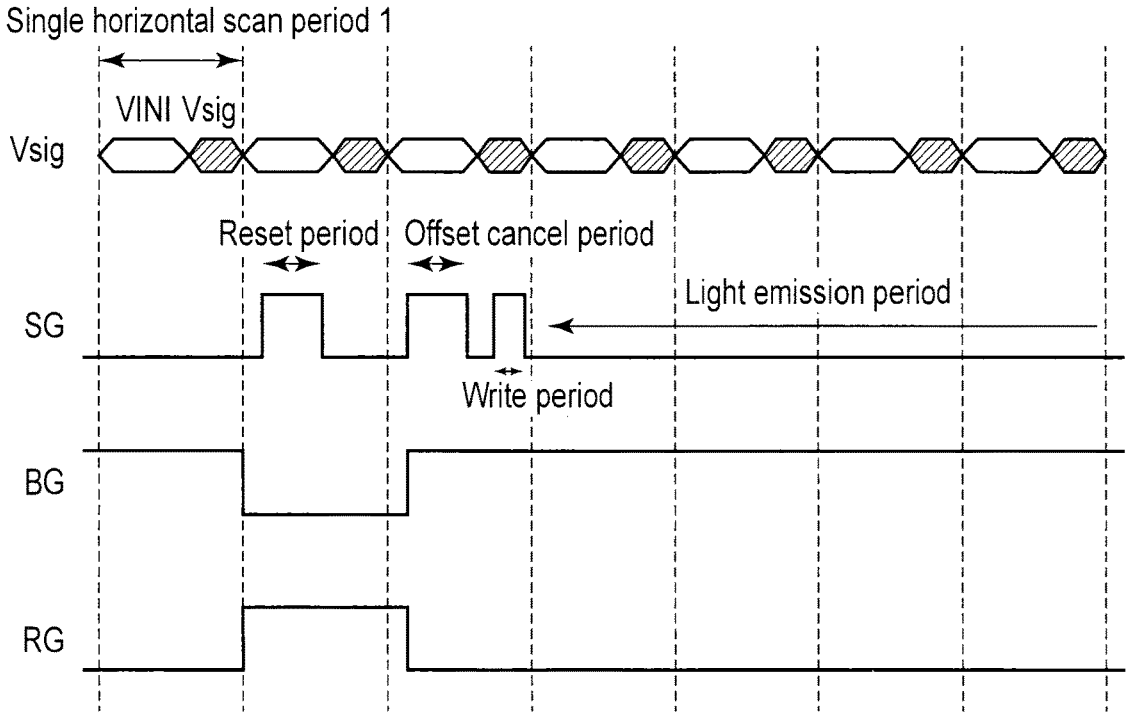
FIG. 3 is an exemplary timing chart which shows control signals of scanning line driving circuits at a display operation time of the display device of the first embodiment.

FIG. 3 is an exemplary timing chart which shows control signals of scanning line driving circuits 4*a* and 4*b* at the display operation time of the display device 10 of the first embodiment.

The operation of the pixel circuit 6 can be classified into a reset operation, offset cancel operation, write operation and light emission operation. Note that, to the image signal lines Sig (1 to n), initialization voltage signals VINI are output in the first half period within one horizontal scan, and gradation voltage signals Vsig are output in the latter half period within one horizontal scan.

[Reset Operation]

In a reset period, scanning line driving circuit 4*a* outputs low-level control signals BG which turn the output switch 13 off (off-potential) and high-level control signals SG which turn the pixel switch 12 on (on-potential). Furthermore, in scanning line driving circuit 4*b*, control signals RG are set to a high level which turns the reset switch 16 on.

Thereby, the output switch 13 is turned off (nonconductive) and the pixel switch 12 and the reset switch 16 are turned on (conductive), and the reset power lines RST supply reset voltage VRST to the driving transistor 11 to start the reset operation. That is, both potentials of the source and the drain of the driving transistor 11 are reset to a potential corresponding to the reset voltage VRST such as −3V, and the potential of the previous frame can be initialized.

In the reset period, initialization voltage signals VINI output from the image signals lines Sig (1 to n) are applied to the gate of the driving transistor 11 through the pixel switch 12. Thereby, the gate potential of the driving transistor 11 is reset to a potential corresponding to the initialization voltage signals VINI and initialized from the state in the previous frame. The initialization voltage signal VINI is set to 1V, for example.

[Offset Cancel Operation]

In an offset cancel operation, control signals SG and BG are set to an on-potential (high level) and control signals RG are set to an off-potential (low level). Thereby, the reset switch 16 is turned off (nonconductive) and the pixel switch 12 and the output switch 13 are turned on (conductive), and the offset cancel operation of a threshold value of the driving transistor 11 is started.

In an offset cancel period, the gate potential of the driving transistor 11 is fixed to VINI since the initialization voltage signals VINI output from image signal lines Sig (1 to n) are applied to the driving transistor 11 through the pixel switch 12.

[Write Operation]

In a write operation, control signals SG and BG are set to an on-potential (high level) and control signals RG are set to off-potential (low level). Thereby, the pixel switch 12 and the output switch 13 are turned on (conductive) and the reset switch 16 is turned off (nonconductive). In a write period, the gradation voltage signals Vsig are written from image signals lines Sig (1 to n) to the gate of the driving transistor 11 through the pixel switch 12.

[Light Emission Operation]

In a light emission period, control signals SG and RG are set to a low level, and control signals BG are set to a high level, and the driving current is supplied from the power line Vdd to the driving transistor 11 of each of red (R), green (G), and blue (B) pixels PX through the output switch 13. The driving transistor 11 outputs the driving current, and amount of the driving current corresponds to the gate control voltage written to the retaining capacitor 14. The driving current is supplied to the organic EL element 15 which emits light with the luminosity corresponding to the supplied driving current. The organic EL element 15 maintains the light emission state until the control signals BG are set to the off-potential again.

The reset operation, offset cancel operation, write operation, light emission operation are repeated in each pixel PX sequentially to display a desired image.

Figure 4:
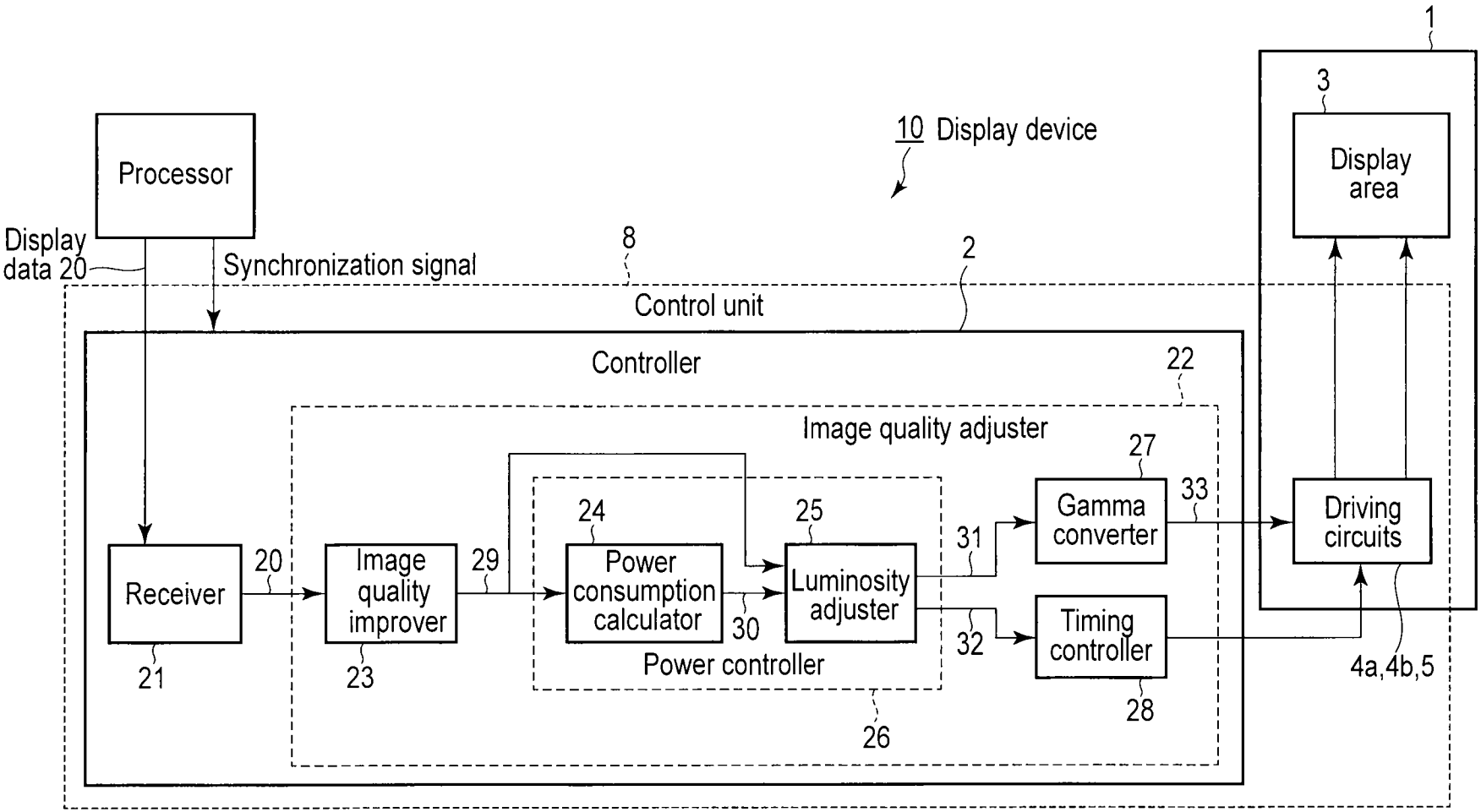
FIG. 4 is an exemplary block diagram which shows a structural example of a controller configured to execute a power control operation of the display device of the first embodiment.

FIG. 4 is an exemplary block diagram which shows a structural example of the controller 2 configured to execute a power control operation of the display device 10 of the first embodiment. Note that parts related to the power control operation are extracted in the illustration of the controller 2 in FIG. 4.

An external processor sends display data 20 as digital image signals and synchronization signals to the controller 2. Here, the processor is an application process processer incorporated in an electronic device, for example. Note that a device to output the display data 20 to the controller 2 is not limited to a processor and may be a memory device, for example.

The controller 2 processes the luminosity of the image signals to improve the display quality of the display data 20 sent from the processor and to reduce the power consumption. The controller 2 outputs the processed image signals and timing signals including processed synchronization signals to the organic EL panel 1. In the organic EL panel 1, the driving circuits (scanning line driving circuits 4*a* and 4*b* and signal line driving circuit 5) drive pixels PX in the display area 3 based on the image signals and the timing signals from the controller 2 to display an image.

Note that, as stated above, the control unit 8 is composed of the controller 2 and the driving circuits (scanning line driving circuits 4*a* and 4*b* and signal line driving circuit 5).

Now, the structure of the controller 2 is explained. The controller 2 comprises a receiver 21 and an image quality adjuster 22.

The receiver 21 receives the display data 20 from the processor as to each display line (row) and sends the received display data 20 to the image quality adjuster 22 as to each line. The image quality adjuster 22 receives the display data 20 from the receiver 21 line by line and adjusts the luminosity of the display data 20 to control the power consumed in the displaying. Furthermore, the image quality adjuster 22 performs a black insertion operation (details are described later) if required.

The image quality adjuster 22 comprises an image improver 23, a power controller 26, a gamma converter 27, and a timing controller 28. The power controller 26 includes a power consumption calculator 24 and luminosity adjuster 25.

The image improver 23 performs noise reduction and the like to improve the display data per line and sends improved display data 29 to the power consumption calculator 24 per line.

The power consumption calculator 24 calculates a necessary power consumption for displaying a current frame (current frame power consumption 30). The power consumption calculator 24 calculates a power consumption (current frame power consumption 30) which is used to display the frame currently being displayed from the frame process start to the current time point. The current frame power consumption 30 is calculated based on the luminosity represented by the per-line improved display data 29. For example, the current frame power consumption 30 can be acquired by multiplying a coefficient used to convert the luminosity to the power consumption per line and accumulating the per-line power consumption from the frame process start to the current time point. The power consumption calculator 24 sends the generated current frame power consumption 30 to the luminosity adjuster 25.

The luminosity adjuster 25 receives the per-line improved display data 29 from the image improver 23. Furthermore, the luminosity adjuster 25 receives the current frame power consumption 30 from the power consumption calculator 24. The luminosity adjuster 25 multiplies the luminosity of the improved display data 29 and a luminosity adjustment factor (described later) per line and sends the multiplied luminosity as output data 31 to a gamma converter 27. Furthermore, the luminosity adjuster 25 multiplies the current frame power consumption 30 and the luminosity adjustment factor (described later) per line and, if a calculation result satisfies a predetermined condition, sends black insertion signals 32 to the timing controller 28. Note that, a predetermined condition may be a condition that a calculation result exceeds a predetermined threshold.

Figure 5:
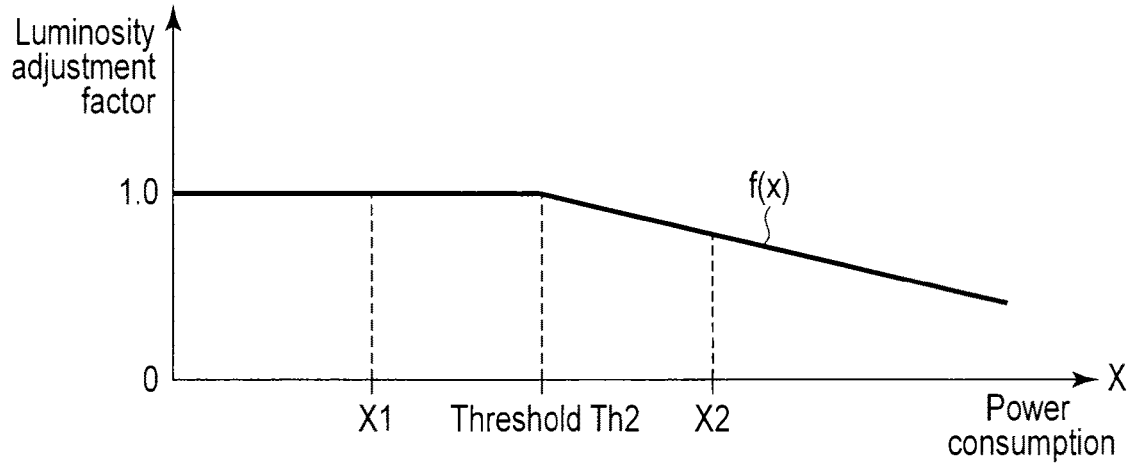
FIG. 5 is an exemplary view which shows a method to acquire a luminosity adjustment factor in the display device of the first embodiment.

FIG. 5 is an exemplary view which shows a method to acquire the luminosity adjustment factor in the display device 10 of the first embodiment.

In the graph of FIG. 5, the horizontal axis indicates a total power consumption (frame power consumption) of the entire lines in one frame in an input image, and the vertical axis indicates the luminosity adjustment factor. Function f(x) used to acquire the luminosity adjustment factor from the frame power consumption is a decreasing function which satisfies $f(x_1) \geq f(x_2)$ if $x_1 < x_2$. That is, when the frame power consumption becomes larger, the luminosity adjustment factor becomes smaller. Here, the luminosity adjustment factor is set to a small value such that the power consumed by the displaying can sufficiently be controlled, and is set to less than 1, for example. Furthermore, the luminosity adjustment factor is determined at the time when the entire display data in one frame are presented. Therefore, the luminosity adjustment factor acquired here is a value to be applied to the next frame.

In FIG. 4, the gamma converter 27 generates digital signals 33 by executing a gamma conversion process with respect to the output data 31 per line and sends the gamma-converted digital signals 33 to the organic EL panel 1. Upon receiving the black insertion signals 32 from the luminosity adjuster 25, the timing controller 28 sends timing signals not to display the digital signals 33 (timing signals not to emit light) to the organic EL panel 1. Note that, although this is not shown, the timing controller 28 sends timing signals to display images to the organic EL panel 1.

The driving circuits (4*a*, 4*b*, and 5) convert the digital signals 33 to analog gradation voltage signals Vsig and supply the signals Vsig to the pixel circuit 6 of the display area 3 through the image signal lines Sig. Furthermore, the driving circuits (4*a*, 4*b*, and 5) supply driving signals to the pixel circuit 6 of the display area 3 based on the timing signals such that display drive and black insertion drive are performed.

Then, an operation of the pixel circuit in the black insertion operation is explained.

In the pixel circuit in FIG. 2, the control signals SG and RG are set to a low level and the control signals BG are set to a high level in the light emission period, and the driving current is supplied from the power line Vdd to the driving transistor 11 of each of the red (R), green (G), and blue (B) pixels PX through the output switch 13. When the black insertion drive is performed, the control signals BG of the corresponding pixel circuit are switched to a low level. Then, the output switch 13 is turned off (nonconductive) and the driving current from the driving transistor 11 is stopped. That is, the organic EL element 15 stops light emission. Consequently, an image without luminosity is displayed in the corresponding row, which is recognized as a black image.

Next, the power control operation of the display device 10 of the first embodiment is explained.

Hereinafter, the display order of the frames goes frame (n−1), frame n, and frame (n+1), and the power control operation is performed targeting frame n.

The power controller 26 calculates power consumption 30 per line using equation (1) as to the per-line display data 29.

$$\text{Power}_i=\{\Sigma R_{IN(i)}\}\times a_R+\{\Sigma G_{IN(i)}\}\times a_G+\{\Sigma B_{IN(i)}\}\times a_B \quad (1)$$

In equation (1), $\text{Power}_i$ is power consumption 30 in display data 29 at ith line. The luminosity of a red pixel in the display data 29 at ith line is $R_{IN(i)}$. The luminosity of a green pixel in the display data 29 at ith line is $G_{IN(i)}$. The luminosity of a blue pixel in the display data 29 at ith line is $B_{IN(i)}$. A coefficient used to convert the luminosity of the red pixel to the power consumption is $a_R$. A coefficient used to convert the luminosity of the green pixel to the power consumption is $a_G$. A coefficient used to convert the luminosity of the blue pixel to the power consumption is $a_B$.

The power consumption in the entire lines in frame n can be represented by equation (2).

$$\text{Power}_n=\Sigma\text{Power}_i \quad (2)$$

The luminosity adjustment factor $K_{n+1}$ used to decrease luminosity of frame (n+1) for the power control is calculated using equation (3).

$$K_{n+1}=f(\text{Power}_n) \quad (3)$$

Here, function f(x) used to acquire the luminosity adjustment factor from the frame power consumption is a decreasing function which satisfies $f(x_1)\geq f(x_2)$ if $x_1<x_2$. If the above conversion is applied to a case where the display data 29 are motion picture data, the power consumption 30 for the display data 29 is a function of time t, and function f(x) is also a function of time t.

The luminosity of a red pixel in frame (n+1) is $R_{IN(n+1)}$. The luminosity of a green pixel in frame (n+1) is $G_{IN(n+1)}$. The luminosity of a blue pixel in frame (n+1) is $B_{IN(n+1)}$. In that case, the luminosity $R_{out(n+1)}$ in red pixel in frame (n+1) of the output data 31, the luminosity $G_{out(n+1)}$ in green pixel in frame (n+1) of the output data 31, and luminosity $B_{out(n+1)}$ in blue pixel in frame (n+1) of the output data 31 are calculated by equations (4) to (6).

$$R_{OUT(n+1)}=K_{n+1}\times R_{IN(n+1)} \quad (4)$$

$$G_{OUT(n+1)}=K_{n+1}\times G_{IN(n+1)} \quad (5)$$

$$B_{OUT(n+1)}=K_{n+1}\times B_{IN(n+1)} \quad (6)$$

As represented by equations (1) to (6), the luminosity adjustment factor $K_{n+1}$ used in the luminosity adjustment of frame (n+1) is calculated based on frame n. Therefore, the luminosity adjustment factor suitable for each frame is acquired in one frame after.

Figure 6A:
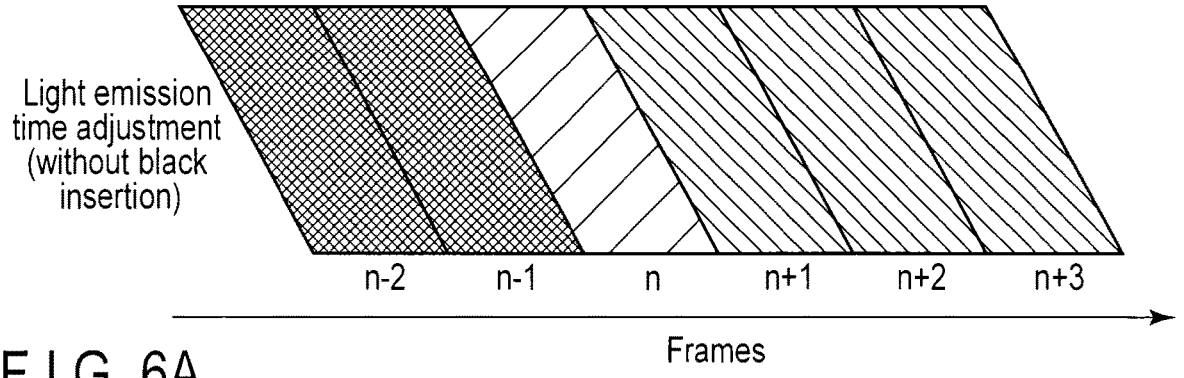
FIG. 6A is an exemplary view used to explain light emission time adjustment in the display device of the first embodiment.
Figure 6B:
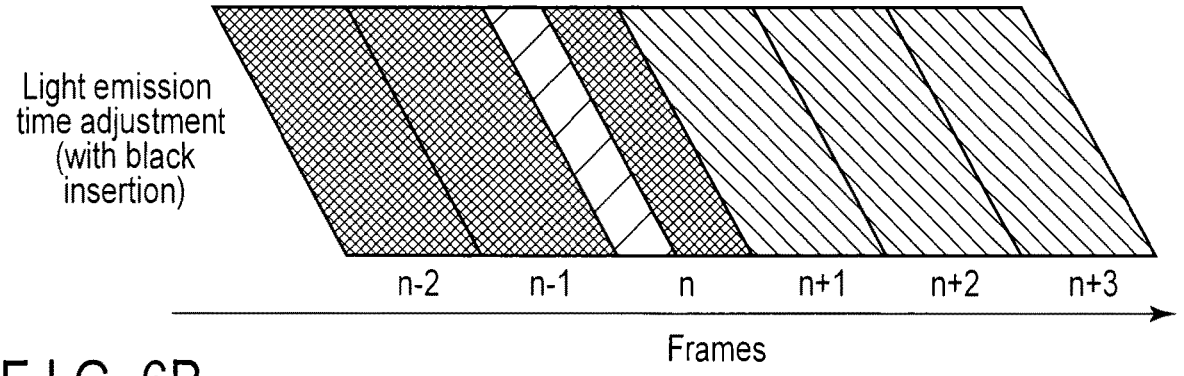
FIG. 6B is an exemplary view used to explain light emission time adjustment in the display device of the first embodiment.

FIGS. 6A and 6B are exemplary views each showing light emission time adjustment in the display device 10 of the first embodiment. FIG. 6A shows a frame display transition without light emission time adjustment (black insertion). FIG. 6B shows a frame display transition with the light emission time adjustment in the display device 10 of the first embodiment.

Firstly, a frame display transition without light emission time adjustment in FIG. 6A is explained.

For example, in the display data 29, black frames continue until frame (n−1) and then yellow frame starts from frame n. The luminosity adjustment factor $K_n$ applied to yellow frame n is calculated based on $\text{Power}_{n-1}$ consumed in black frame (n−1), and $K_n=f(\text{Power}_{n-1})$. That is, although frame n is yellow, the luminosity adjustment factor $K_n$ corresponding to frame n is calculated based on black frame (n−1).

The luminosity adjustment factor suitable for the yellow frame is calculated based on $\text{Power}_n$ consumed by yellow frame n and is $K_{n+1}=f(\text{Power}_n)$. It is used in yellow frame (n+1) and thereafter. Here, $\text{Power}_n$ consumed in yellow frame n is greater than $\text{Power}_{n-1}$ consumed in black frame (n−1). The luminosity adjustment factor is acquired by a decreasing function which decreases as power consumption increases. Therefore, luminosity adjustment factor $K_{n+1}$ applied to frame (n+1) is smaller than luminosity adjustment factor $K_n$ applied to frame n. Therefore, frame n is displayed brighter than frame (n+1).

In such a frame display transition, only frame n is much brighter than any other frames during the image switching. As a result, a flash phenomenon, by which the display surface looks brighter for an instant, occurs.

Next, a frame display transition with a light emission time adjustment of the display device 10 of the first embodiment is explained. In the first embodiment, power consumption of frame n and power consumption of frame (n−1), that is, a difference in the luminosities is reduced to prevent the flash phenomenon.

In the first embodiment, as exemplified in FIG. 6B, a black insertion is performed with respect to frame n during switching from black frame (n−1) to yellow frame n for luminosity adjustment. Luminosity adjustment factor $K_{n+1}$ calculated based on yellow frame n to correspond thereto is used for the luminosity of frame (n+1). That is, if frame n is brighter than frame (n−1) so as to generate a flash phenomenon, a black insertion is performed to control the evenness of light emission in the frames and a difference in the luminosities between frame (n−1) and frame n, and a difference in the luminosities between frame n and subsequent frame (n+1) are adjusted.

Figure 7:
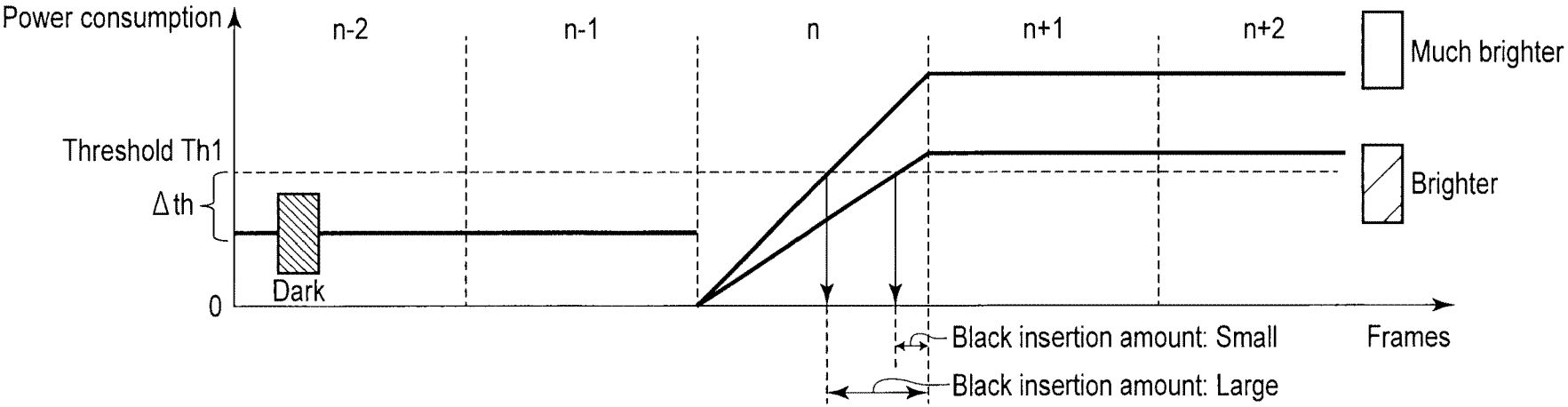
FIG. 7 is an exemplary graph which shows a relationship between light emission adjustment timing and power consumption in the display device of the first embodiment.

FIG. 7 is an exemplary graph which shows a relationship between light emission adjustment timing and power consumption in the display device 10 of the first embodiment. In FIG. 7, the horizontal axis indicates time and frame switching points and the vertical axis indicates power consumption. Frames start from frame (n−2) and proceed to frame (n+2). Note that in FIG. 7, frame n shows that its luminosity increases as time passes. As the vertical axis in FIG. 7 shows the current frame power consumption 30, the power consumption is a sum of the lines whose luminosities are updated from those in the previous frame. In each of the frames other than frame n, the power consumption at the time of completion of a frame depiction is indicated, instead of a change of power consumption along with passing time, to be compared to the power consumption in frame n. Frame (n−2) and frame (n−1) are dark frames, and frame (n+1) and frame (n+2) are classified into a brighter frame and a much brighter frame.

In the first embodiment, the amount of black insertion increases and decreases depending on a difference in the luminosities between frame (n−1) and frame n. Specifically, the power consumption at the time of frame n (current frame power consumption) acquired by accumulating pixel values of frame n in each line increases during the depiction of frame n. A slope of increasing power consumption becomes steeper when frame n becomes brighter.

Considering the above, threshold Th1 which is a combination of the power consumption of frame (n−1) and a bias Δth is given, and the black insertion is performed at the moment when the current frame power consumption of frame n exceeds threshold Th1. If frame n is a brighter frame, the moment when the current frame power consumption of frame n exceeds threshold Th1 is delayed and the amount of black insertion decreases. If frame n is much brighter frame, the moment when the power consumption of frame n exceeds threshold Th1 is advanced and the amount of black insertion increases. That is, if the moment when the current frame power consumption of frame n exceeds threshold Th1 is delayed more, the amount of black insertion decreases more. If the moment when the current frame power consumption of frame n exceeds threshold Th1 is advanced more, the amount of black insertion increases more. Since the black insertion is performed at the moment when the current frame power consumption of frame n exceeds threshold Th1, the amount of black insertion corresponding to the brightness of the frame can be determined automatically.

When the black insertion operation is started, light emission of the organic EL element 15 in a first line which is the upper end line of the display area 3 is stopped. Each time when the display data 20 of new subsequent line are processed, the number of line of which light emission is stopped is incremented one by one. That is, the black image gradually increases from the upper end line (first line) to the lower lines in the display area 3.

In general, to compare data in frame n to data in frame (n+1), a frame memory to store display data 29 is used. However, a frame memory requires a capacity to store data of one frame, and thus, increases production costs. With the above-mentioned method using the current frame power consumption (accumulated value), this process can be performed without using a frame memory and the increase of the production costs can be suppressed.

Figure 8:
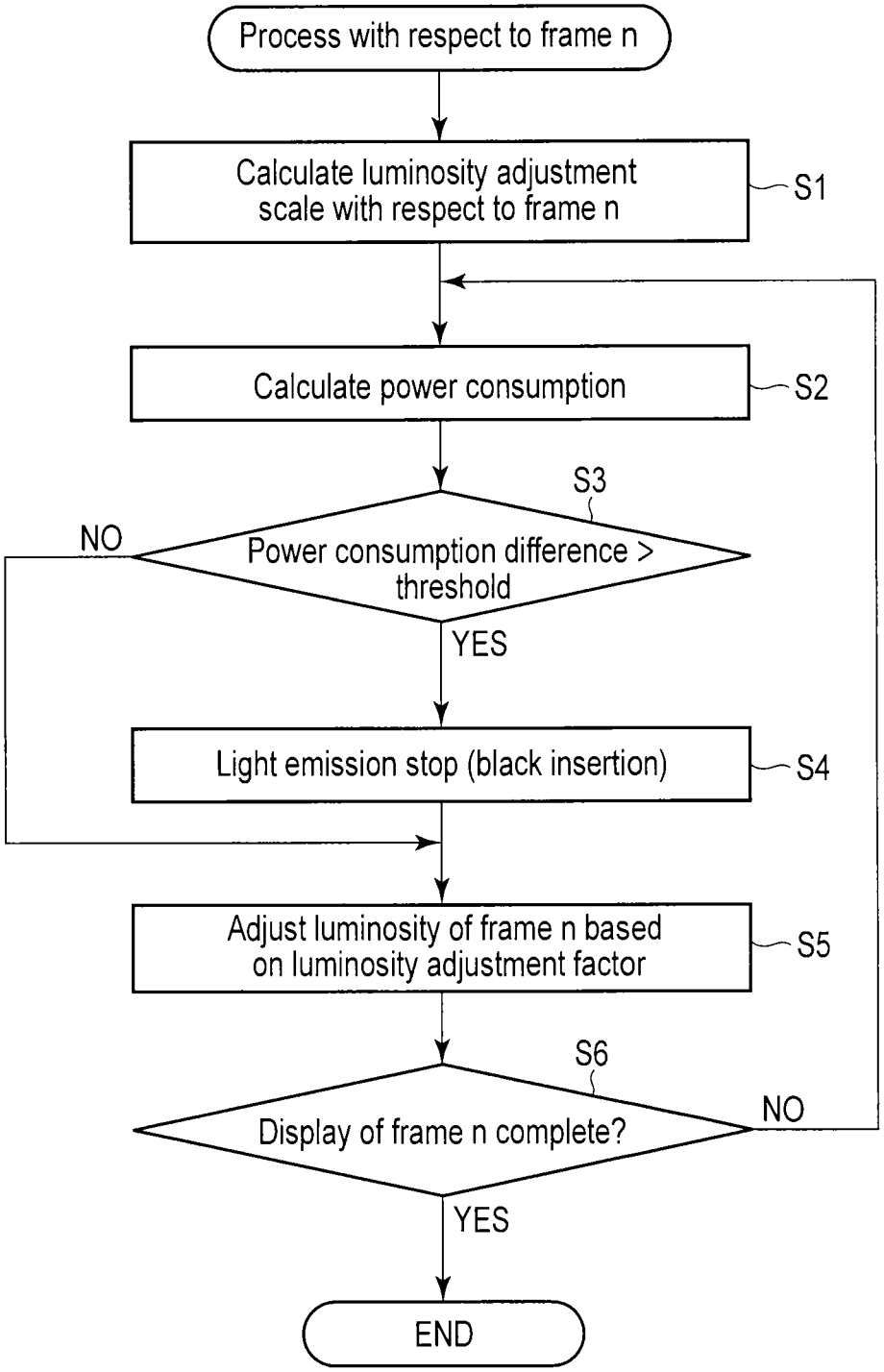
FIG. 8 is an exemplary flowchart which shows an example of a process of a power controller and a timing controller with respect to frame n in the display device of the first embodiment.

FIG. 8 is an exemplary flowchart which shows an example of a process of the power controller 26 and the timing controller 28 with respect to frame n in the display device 10 of the first embodiment.

When display of frame n is started, the luminosity adjuster 25 acquires luminosity adjustment factor $K_n$ applied to frame n in step S1. Luminosity adjustment factor $K_n$ may be calculated using a decreasing function based on the power consumption of frame (n−1) (accumulated value). Or, luminosity adjustment factor $K_n$ which has already been calculated at the time of completion of frame (n−1) to be applied to frame n may be used.

In step S2, the power consumption calculator 24 calculates the power currently being consumed in frame n (current frame power consumption) using per-line improved display data 29 from the image improver 23. In the calculation of the power currently being consumed, the display data 29 multiplied by luminosity adjustment factor $K_n$ are used.

In step S3, the luminosity adjuster 25 determines whether or not a difference between the power consumption currently being consumed in frame n and the power consumption of frame (n−1) exceeds threshold Th1 which is set to prevent a flash phenomenon. If a difference between the power consumption currently being consumed in frame n and the power consumption of frame (n−1) does not exceed threshold Th1, the process goes to step S5. If a difference between the power consumption currently being consumed in frame n and the power consumption of frame (n−1) exceeds, the process goes to step S4.

In step S4, the luminosity adjuster 25 sends black insertion signals 32 to the timing controller 28, and the timing controller 28 starts or continues the light emission stop operation (black insertion operation) from the first line.

In step S5, the luminosity adjuster 25 calculates output data 31 in each line by multiplying the luminosity of the improved display data 29 by luminosity adjustment factor $K_n$ in each line and sends the output data 31 in each line to the gamma converter 27. Then, the process goes to step S6.

In step S6, if the display of frame n is completed, the process with respect to frame n is terminated. If the display of frame n is not completed, the process returns to step S3 after the input of next per-line improved display data 29 from the image improver 23.

In the display device 10 of the first embodiment as described above, the amount of black insertion can be adjusted depending on luminosity of frames. Thus, power consumption can be reduced, a flash phenomenon can be suppressed, and deterioration of display quality can be prevented.

Second Embodiment

The second embodiment is a variation of the first embodiment. The parts functioning the same as or similarly to those in the first embodiment will be referred to by the same reference numbers and detailed description thereof will be omitted.

In the first embodiment, if there is a little difference between the power consumption of frame (n−1) and frame n, the amount of black insertion in frame n is adjusted to be reduced. However, even if a little amount of black insertion is performed, it may be visually recognized by a user as a flicker, for example, and the display quality may be deteriorated. Therefore, in the second embodiment, black insertion is not performed if a difference in luminosities between adjacent frames is little enough to be recognized as a flash phenomenon.

In the second embodiment, a difference in the luminosities between frame n and frame (n+1) is estimated halfway through the display of frame n which is a display target. For example, during the display of frame n in FIG. 7, possible power consumption (≈luminosity value) at the time of completion of the display of frame n can be estimated by inserting an increasing curve using various methods.

From the estimated power consumption at the time of completion of the display of frame n, luminosity adjustment factor $K_{n+1}$ to be applied to display of frame (n+1) can be acquired. Providing that power consumption of frame (n+1) before the luminosity adjustment factor operation is approximately equal to power consumption of frame n before the luminosity adjustment factor operation, power consumption of frame (n+1) after the luminosity adjustment factor operation will approximately be acquired by equation (7).

$$\text{Power consumption of frame } (n+1) \approx (K_{n+1}/K_n) \times \text{Power consumption of frame } n \quad (7)$$

Then, if a luminosity difference (power consumption difference) acquired by subtracting the estimated luminosity (power consumption) of frame (n+1) from the estimated luminosity (power consumption) of frame n is little enough to be recognized as a flash phenomenon, the luminosity adjuster 25 controls not to stop light emission (not to perform black insertion) with respect to frame n. Note that although the power consumption is used in the above explanation, the estimation may be performed using luminosity values accumulated.

Figure 9:
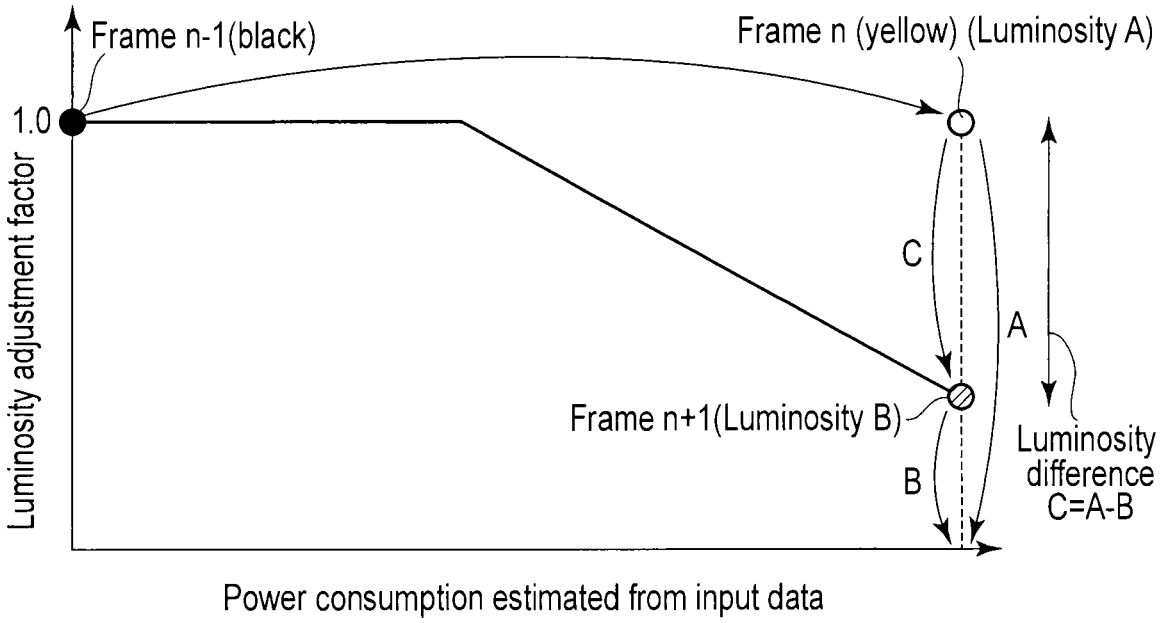
FIG. 9 is an exemplary graph which shows a relationship between estimated power consumption and luminosity adjustment factor in a case where black frame (n−1) changes to yellow frame n in a display device of a second embodiment.

FIG. 9 is an exemplary graph which shows a relationship between estimated power consumption and luminosity adjustment factor in a case where black frame (n−1) changes to yellow frame n in the display device 10 of the second embodiment.

The luminosity adjuster 25 estimates luminosity A (power consumption) of yellow frame n from a slope in a curve of the power consumption shown in FIG. 7. At that time, a luminosity adjustment factor of yellow frame n and a luminosity adjustment factor of black frame (n−1) are the same. Luminosity (power consumption) B of frame (n+1) is a product of the estimated luminosity A of frame n and a luminosity adjustment factor calculated based on the estimated luminosity of frame n.

The luminosity adjuster 25 calculates a luminosity difference C based on a value acquired by subtracting the estimated luminosity B of frame (n+1) from the estimated luminosity A of frame n. Then, if the luminosity difference C is less than threshold Th3, the luminosity adjuster 25 does not send black insertion signals 32 to the timing controller 28.

Figure 10:
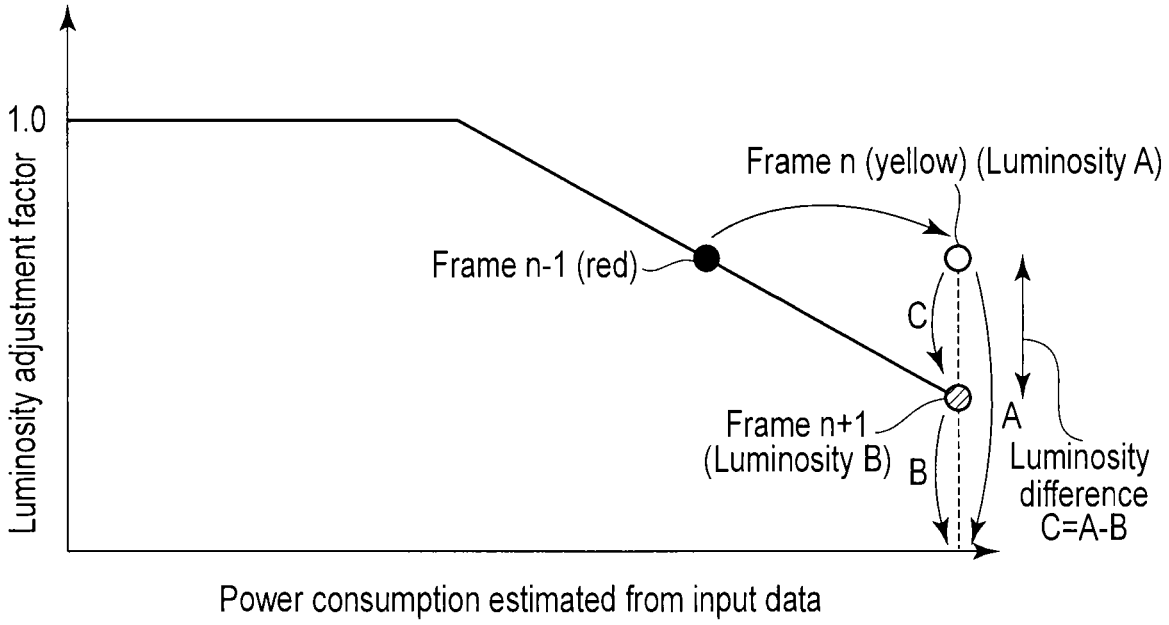
FIG. 10 is an exemplary graph which shows a relationship between estimated power consumption and luminosity adjustment factor in a case where red frame (n−1) changes to yellow frame n in the display device of the second embodiment.

FIG. 10 is an exemplary graph which shows a relationship between estimated power consumption and luminosity adjustment factor in a case where red frame (n−1) changes to yellow frame n in the display device 10 of the second embodiment.

The luminosity adjuster 25 estimates luminosity A (power consumption) of yellow frame n from a slope in a curve of the power consumption shown in FIG. 7. At that time, a luminosity adjustment factor of yellow frame n and a luminosity adjustment factor of red frame (n−1) are the same. Luminosity (power consumption) B of frame (n+1) is a product of the estimated luminosity A of frame n and a value acquired by operating a luminosity adjustment factor calculated based on the estimated luminosity of frame n and the luminosity adjustment factor of red frame (n−1).

The luminosity adjuster 25 calculates a luminosity difference C based on a value acquired by subtracting the estimated luminosity B of frame (n+1) from the estimated luminosity A of frame n. Then, if the luminosity difference C is less than threshold Th3, the luminosity adjuster 25 does not send black insertion signals 32 to the timing controller 28.

Figure 11:
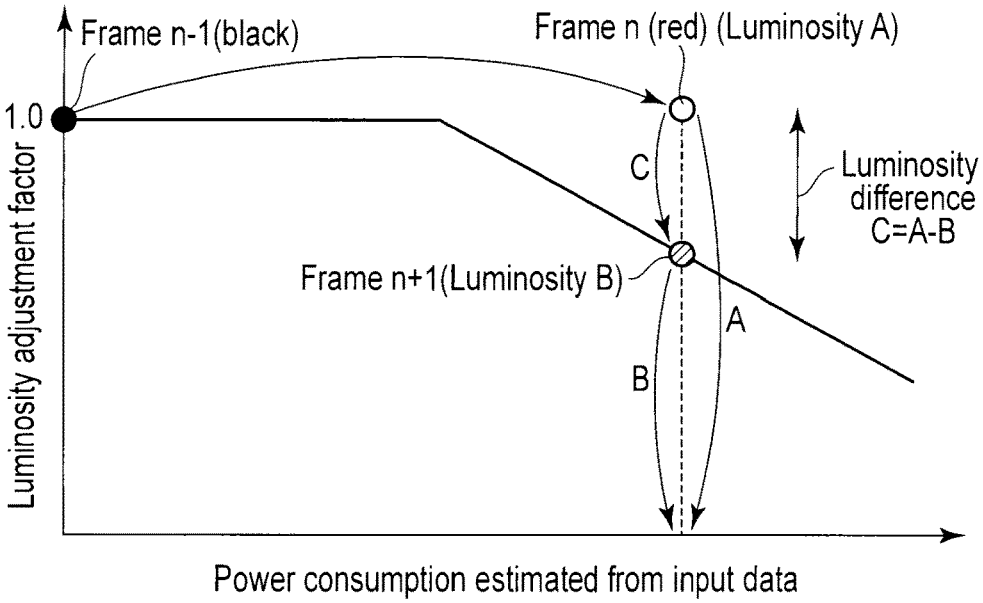
FIG. 11 is an exemplary graph which shows a relationship between estimated power consumption and luminosity adjustment factor in a case where black frame (n−1) changes to red frame n in the display device of the second embodiment.

FIG. 11 is an exemplary graph which shows a relationship between estimated power consumption and luminosity adjustment factor in a case where black frame (n−1) changes to red frame n in the display device 10 of the second embodiment.

The luminosity adjuster 25 estimates luminosity A (power consumption) of red frame n from a slope in a curve of the power consumption shown in FIG. 7. At that time, a luminosity adjustment factor of red frame n and a luminosity adjustment factor of black frame (n−1) are the same. Luminosity (power consumption) B of frame (n+1) is a product of the estimated luminosity A of frame n and a value acquired by operating a luminosity adjustment factor calculated based on the estimated luminosity of frame n and the luminosity adjustment factor of black frame (n−1).

The luminosity adjuster 25 calculates a luminosity difference C based on a value acquired by subtracting the estimated luminosity B of frame (n+1) from the estimated luminosity A of frame n. Then, if the luminosity difference C is less than threshold Th3, the luminosity adjuster 25 does not send black insertion signals 32 to the timing controller 28.

In the second embodiment, a difference in the luminosities between frame n which is a display target and its subsequent frame (n+1) is estimated to determine whether or not black insertion is performed. That is, if a luminosity difference C is hardly recognized as a flash phenomenon, black insertion is not performed. Therefore, in the second embodiment, power consumption can be reduced, a flash phenomenon can be suppressed, and deterioration of display quality can be prevented, even without a frame memory.

Third Embodiment

The second embodiment is a variation of the first and second embodiments. The parts functioning the same as or similarly to those in the first and second embodiments will be referred to by the same reference numbers and detailed description thereof will be omitted.

In the first and second embodiments, a frame is composed of red, green, and blue pixels. However, the frame structure is not limited thereto and may include a different color pixel or pixels.

Specifically, a frame may be composed of red, green, blue, and white pixels. In that case, power consumption in each line of frame n ($\text{Power}_n$) will be calculated based on equation (8).

$$\text{Power}_n = \{\Sigma R_{IN(i)}\} \times a_R + \{\Sigma G_{IN(i)}\} \times a_G + \{\Sigma B_{IN(i)}\} \times a_B + \{\Sigma W_{IN(i)}\} \times a_W \quad (8)$$

The luminosity of a white pixel in frame n is $W_{IN(i)}$. A coefficient used to convert the luminosity of the white pixel to the power consumption is $a_W$.

Luminosity $W_{out(n+1)}$ in white pixel in frame (n+1) of the output data 31 is calculated by equation (9).

$$W_{OUT(n+1)} = K_{n+1} \times W_{IN(n+1)} \quad (9)$$

By calculating the above equation with the luminosity adjuster 25, a frame additionally including a white pixel can achieve the advantages as in the first and second embodiments.

Fourth Embodiment

The fourth embodiment is a variation of the first embodiment. The parts functioning the same as or similarly to those in the first embodiment will be referred to by the same reference numbers and detailed description thereof will be omitted.

In the first embodiment, when black insertion is performed in a frame, consecutive lines after a first line are displayed in black. In such a black insertion manner, both a period in which organic EL continuously emits light (a period between a start of the frame and a start of the black insertion) and a period in which organic EL does not continuously emit light (a period between the start of the black insertion and an end of the frame) continues for a long time, and thus, the black insertion is easily recognized. This will cause display quality deterioration as a flicker. In consideration of this point, in the fourth embodiment, the black insertion is performed by dividing the black insertion period into small parts. Thus, a time difference between the light emission period and the non-light emission period is shortened and flicker is reduced.

Figure 12A:
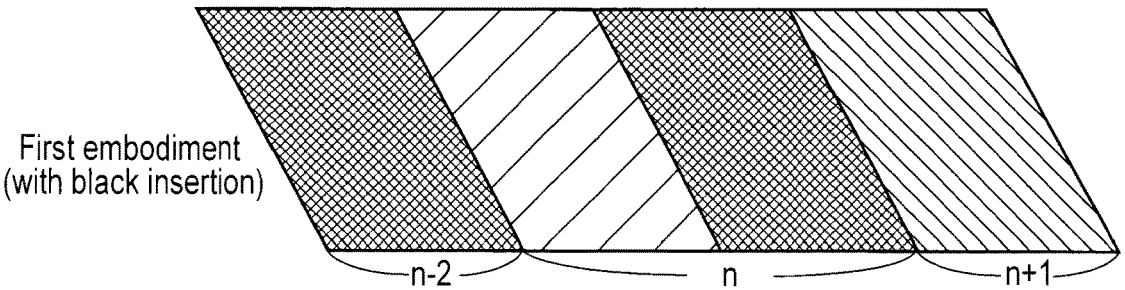
FIG. 12A is an exemplary view used to explain light emission time adjustment in a display device of a fourth embodiment.
Figure 12B:
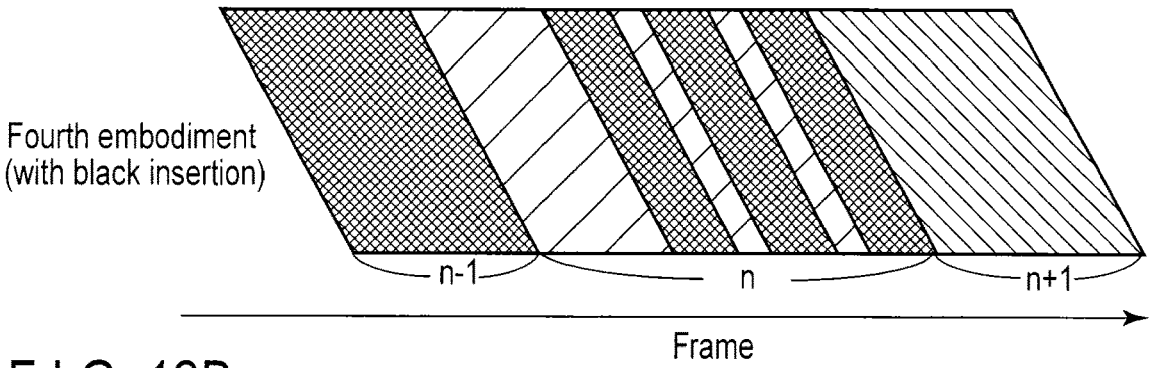
FIG. 12B is an exemplary view used to explain light emission time adjustment in the display device of the fourth embodiment.

FIGS. 12A and 12B are exemplary views each showing light emission time adjustment in a display device 10 of the fourth embodiment. FIG. 12A shows a frame display transition with the light emission time adjustment of the display device 10 of the first embodiment. FIG. 12B shows an example of a frame display transition with the light emission time adjustment in the display device 10 of the fourth embodiment.

The light emission time adjustment of the display device 10 of the first embodiment in FIG. 12A has already been explained, and will not be repeated in this section.

In the fourth embodiment shown in FIG. 12B, the black insertion is performed with respect to frame n when black frame (n−1) is switched to yellow frame n for the luminosity adjustment. The black insertion is performed by incrementing the lines from the first line in the display area 3. However, when a predetermined time passes after the start of the black insertion, an image display operation to display an original yellow image is performed by incrementing the lines from the first line in the display area 3. Then, when a predetermined time passes after the start of the image display operation, the black insertion operation is again performed incrementing the lines from the first line in the display area 3. Then, the image display operation and the black insertion operation are performed alternately until the end of the frame n. Here, the black insertion operation is performed when the current power consumption (accumulated value) exceeds a predetermined threshold.

Figure 13:
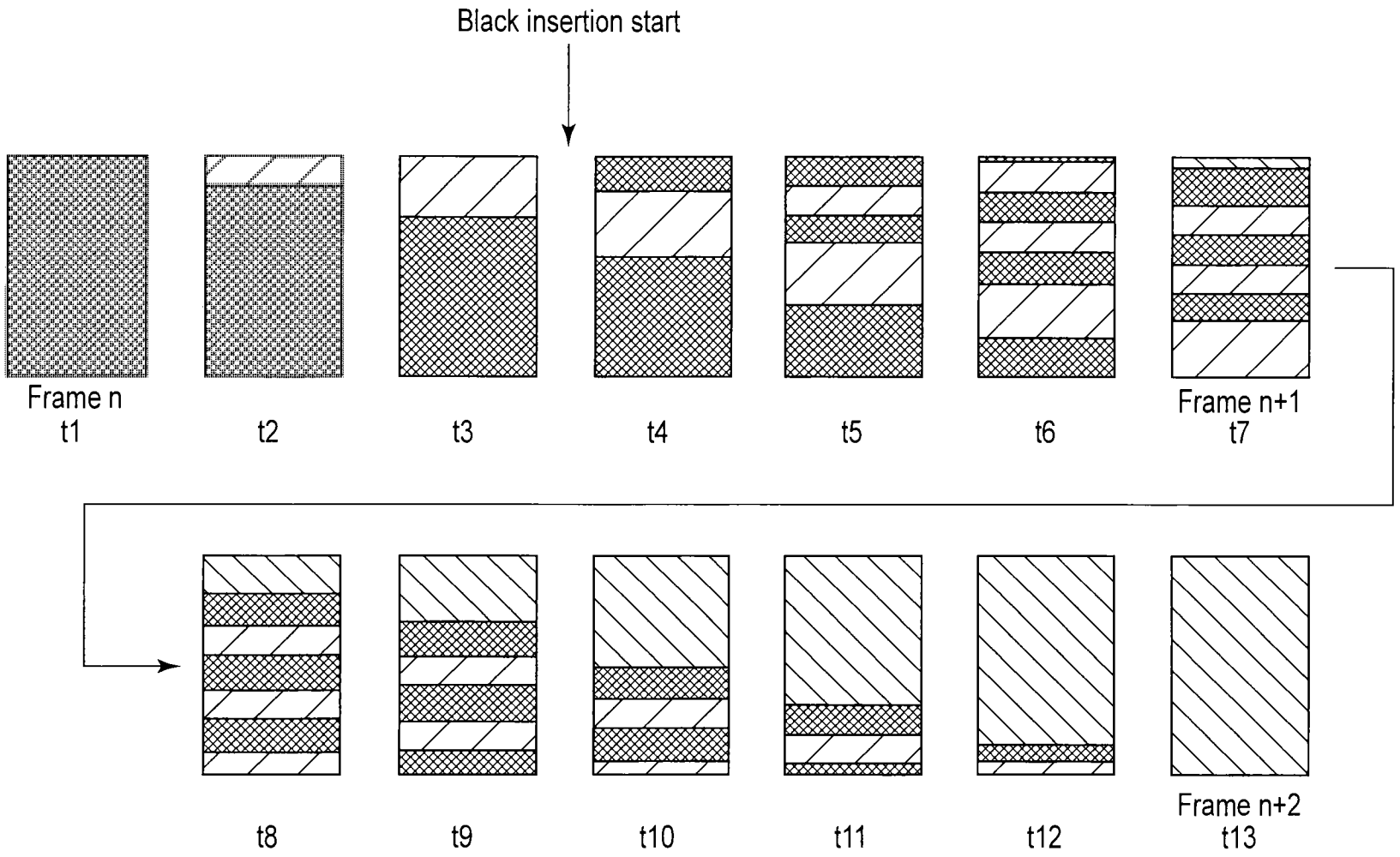
FIG. 13 is another exemplary view which shows light emission time adjustment in the display device of the fourth embodiment.

FIG. 13 is another exemplary view which shows light emission time adjustment in the display device 10 of the fourth embodiment. FIG. 13 shows a time transition on a screen in which black frame continues until frame (n−1) and then yellow frame appears from frame n.

At time t1, when frame n starts, the screen is black. At time t2, a yellow image of frame n starts from the first line of the display area 3. Note that the luminosity of the yellow image of frame n is acquired based on a luminosity adjustment factor calculated based on black frame (n−1). At time t3, the display area of the yellow image of frame n extends. Between time t3 and time t4, the power currently being consumed in frame n is determined to be beyond threshold Th1, and the black insertion is started.

At time t4, the yellow image display area extends downward and the black insertion area starts from the upper end of the screen extending downward. At time t5, the yellow image display area extends downward and, following the black insertion area, the original yellow image area starts from the upper end of the screen extending downward. Then, a black insertion area starts from the upper end of the screen extending downward. At time t6, the condition of time t5 proceeds and the black insertion images and the yellow images are displayed alternately.

At time t7, the yellow image of frame n reaches the lower end of the screen and frame (n+1) starts. A yellow image of frame (n+1) starts from the first line of the display area 3. Note that the luminosity of frame (n+1) showing yellow of lower luminosity (the medium gradation parts in FIG. 13) is acquired based on the luminosity adjustment factor calculated based on yellow frame n. From time t8 to time t12, the condition of time t7 proceeds. That is, a yellow and black stripe image moves downward while a yellow image of frame (n+1) extends downward from above. At time t13, the entire screen is covered with the yellow image of frame (n+1) and frame (n+2) starts.

Figure 14A:
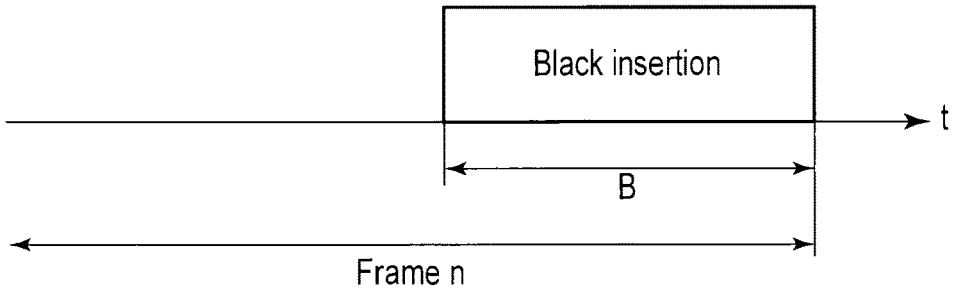
FIG. 14A is an exemplary view used to explain a black insertion method in the display device of the fourth embodiment.
Figure 14B:
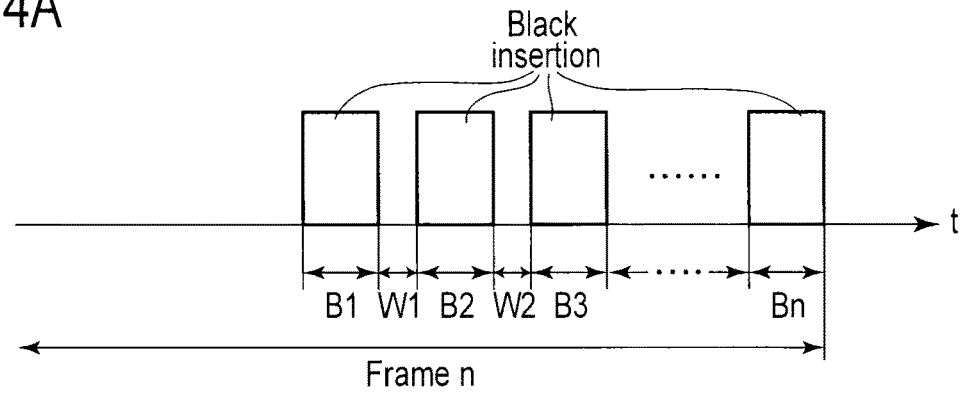
FIG. 14B is an exemplary view used to explain a black insertion method in the display device of the fourth embodiment.

FIGS. 14A and 14B are exemplary views used to explain a black insertion method of the display device 10 of the fourth embodiment. FIG. 14A shows a black insertion method of the first embodiment. FIG. 14B shows a black insertion method of the fourth embodiment.

FIG. 14A shows a black insertion period transition at a certain position on the screen, for example, at the upper end line on the screen. In the black insertion method of the first embodiment, when the black insertion starts, the black insertion period continues until the end of the frame. FIG. 14B shows a black insertion period transition at a certain position on the screen, for example, at the upper end line on the screen. In the black insertion method of the fourth embodiment, when the black insertion starts, the black insertion period continues intermittently. Note that an image of frame n is displayed in a period without the black insertion.

Here, in the fourth embodiment, the time of continuation of the black insertion (B1, B2, . . . ) and the time of continuation of the frame image (W1, W2, . . . ) may be determined preliminarily. Furthermore, the time of continuation of the black insertion may be set such that B=B1+B2+ . . . +Bn.

As above, the black insertion may be interpreted as an operation to display a display pattern including a plurality of continuing black display lines to be synchronized with supply of image signals, moving the pattern downward from the upper line on the display panel, that is, an operation to move the display pattern in the same direction as screen scanning. More specifically, the display pattern of the black insertion may be interpreted as a display pattern in which a plurality of continuing black display lines are repeated with certain intervals.

Note that, in the display method of the fourth embodiment, black insertion images and display images are repeated alternately with certain time intervals when a display line is focused on. This operation can be explained with reference to the pixel circuit shown in FIG. 2. The black insertion is achieved by switching the control signals BG of the corresponding pixel circuit to a low level to turn off the output switch 13 (nonconductive) and the light emission condition of the original image can be achieved by switching the control signals BG of the corresponding pixel circuit to a high level to turn on the output switch 13 (conductive).

Fifth Embodiment

The fifth embodiment is a variation of the fourth embodiment. The parts functioning the same as or similarly to those in the fourth embodiment will be referred to by the same reference numbers and detailed description thereof will be omitted.

Figure 15:
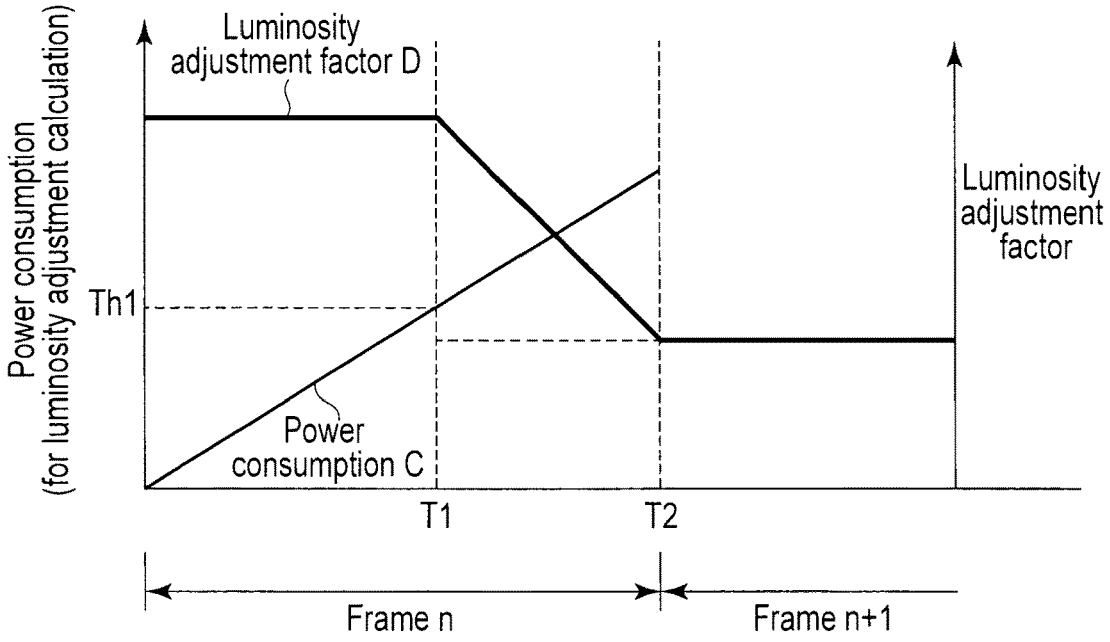
FIG. 15 is an exemplary view which is used to explain light emission time adjustment in a display device of a fifth embodiment.

FIG. 15 is an exemplary view which is used to explain light emission time adjustment in a display device 10 of the fifth embodiment. FIG. 15 shows a time transition curve C of power consumption for luminosity adjustment calculation (not multiplied by a luminosity adjustment factor) and a time transition curve D with a luminosity adjustment factor applied thereto (corresponding to a curve in FIG. 5). The horizontal axis indicates time and frame switching points.

From the start point of frame n, the time transition curve C of the power consumption for luminosity adjustment calculation increases. At time T1, the curve C exceeds threshold Th1. As a result, as explained with reference to FIG. 7, the black insertion starts. At the same time, the luminosity adjuster 25 calculates the luminosity adjustment factor from the power consumption currently being consumed using a decreasing function shown in FIG. 5, acquires output data 31 of each line by multiplying the improved display data 29 of each line by the calculated luminosity adjustment factor, and sends the output data 31 to the gamma converter 27. The luminosity adjuster 25 repeats this operation in each line. Thus, the time transition curve D of the luminosity adjustment factor continuously decreases. As a result, when frame n ends at time T2, the luminosity adjustment factor of the curve D becomes equal to the luminosity adjustment factor applied to frame (n+1).

Figure 16:
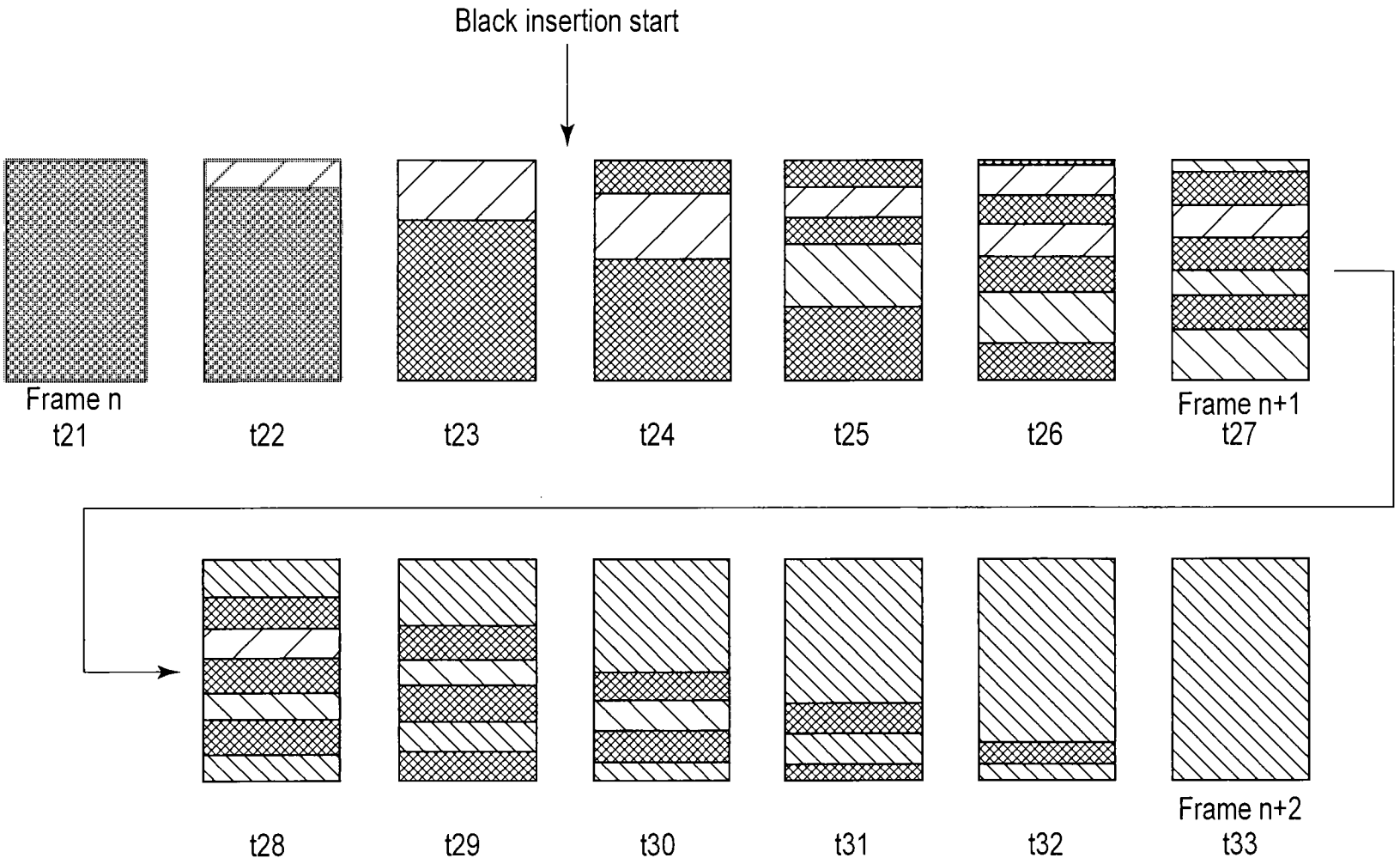
FIG. 16 is another exemplary view which shows light emission time adjustment in a display device of a fifth embodiment.

FIG. 16 is another exemplary view which shows light emission time adjustment in the display device 10 of the fifth embodiment. FIG. 16 shows a time transition on a screen in which black frame continues until frame (n−1) and then yellow frame appears from frame n.

At time t21, when frame n starts, the screen is black. At time t22, a yellow image of frame n starts from the first line of the display area 3. Note that the luminosity of the yellow image of frame n is acquired based on a luminosity adjustment factor calculated based on black frame (n−1). At time t23, the display area of the yellow image of frame n extends. Between time t23 and time t24, the power consumption of frame n is determined to be beyond threshold Th1, and the black insertion is started.

At time t24, the yellow image display area extends downward and the black insertion area starts from the upper end of the screen extending downward. Here, the luminosity of the yellow image of the extending area is acquired by multiplying the current luminosity by a newly calculated luminosity adjustment factor. Thus, the luminosity of the yellow image decreases. At time t25, the yellow image display area extends downward and the luminosity of the yellow image in the extending area further decrease. Furthermore, following the black insertion area, the original yellow area starts from the upper end of the screen extending downward and a black insertion area starts from the upper end of the screen extending downward. At time t26, the condition of time t25 proceeds and the black insertion images and the yellow images are displayed alternately. At that time, the luminosity of the yellow image displayed in line positions on the screen is constant. That is, the luminosity of the yellow image displayed in the same line on the screen is the luminosity at time t25.

At time 27, the yellow image of the frame n reaches the lower end, frame n ends, and frame (n+1) starts. A yellow image of frame (n+1) starts from the first line of the display area 3. Here, the luminosity of the yellow image of frame n displayed at the lower end of the screen becomes equal to the luminosity of the yellow image of frame (n+1). Note that the luminosity of frame (n+1) showing yellow of lower luminosity (the medium gradation parts) is acquired based on the luminosity adjustment factor calculated based on yellow frame n. From time t28 to time t32, the condition of time t27 proceeds. That is, a yellow and black stripe image moves downward while a yellow image of frame (n+1) extends downward from above. At time t33, the entire screen is covered with the yellow image of frame (n+1) and frame (n+2) starts.

If the same light emission period as that is used for the continuous black insertion operation is secured in the black insertion operation performed in a dividing manner, the black insertion operation is started relatively early. That is, unnecessary black insertion may be performed. Therefore, in the fifth embodiment, the start of the black insertion operation is unchanged and the luminosity adjustment factor is decreased after the start of the black insertion operation in order to prevent display quality deterioration by flashing or the like. Note that, as above, a new luminosity adjustment factor is calculated line by line such that it becomes equal to a luminosity adjustment factor of next frame at the last line of the frame.

Sixth Embodiment

The sixth embodiment is a variation of the fourth embodiment. The parts functioning the same as or similarly to those in the fourth embodiment will be referred to by the same reference numbers and detailed description thereof will be omitted.

Figure 17:
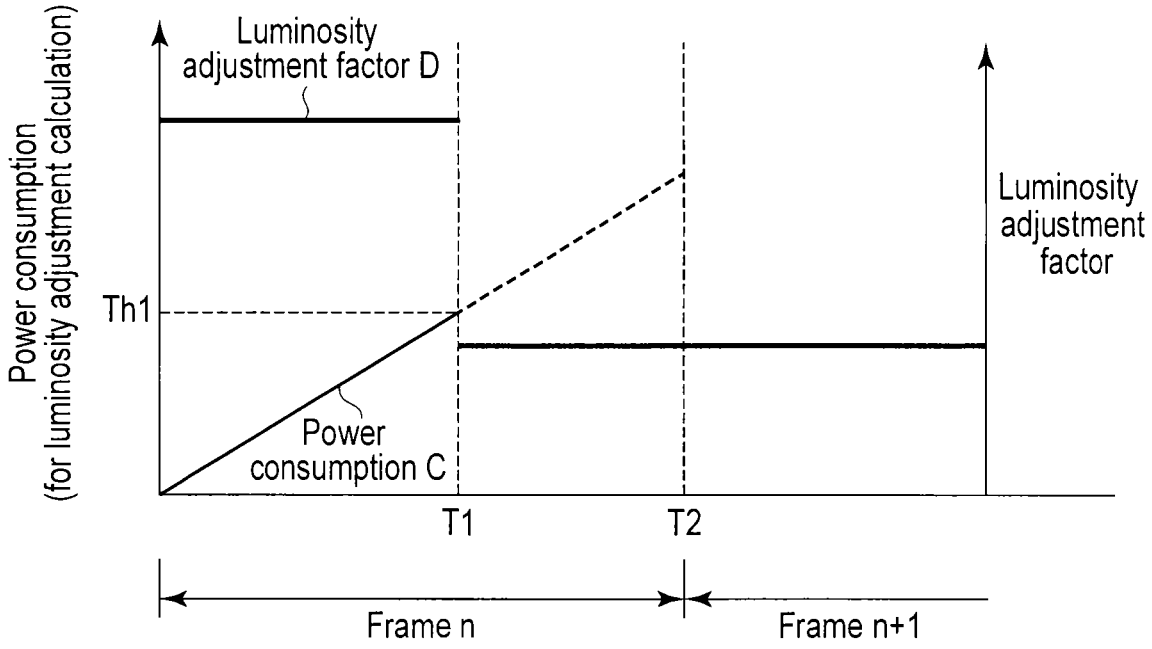
FIG. 17 is an exemplary view which is used to explain light emission time adjustment in a display device of a sixth embodiment.

FIG. 17 is an exemplary view which is used to explain light emission time adjustment in a display device 10 of the sixth embodiment. FIG. 17 shows a time transition curve C of power consumption for luminosity adjustment calculation (not multiplied by a luminosity adjustment factor) and a time transition curve D with a luminosity adjustment factor applied thereto (corresponding to a curve in FIG. 5). The horizontal axis indicates time and frame switching points.

From the start point of frame n, the time transition curve C of the power consumption for luminosity adjustment calculation increases. At time T1, the curve C exceeds threshold Th1. As a result, as explained with reference to FIG. 7, the black insertion starts. At the same time, the luminosity adjuster 25 estimates the power consumption at the time of end of the display of frame n and acquires a luminosity adjustment factor applied to the display of frame (n+1) from the estimated power consumption of frame n. This method has already been explained using equation (7), and will not be repeated in this section. The luminosity adjuster 25 acquires output data 31 of each line by multiplying the improved display data 29 of each line by the calculated luminosity adjustment factor and sends the output data 31 to the gamma converter 27. The luminosity adjuster 25 repeats this operation in each line. Thus, the luminosity adjustment factor of the time transition curve D becomes equal to the luminosity adjustment factor applied to frame (n+1).

Figure 18:
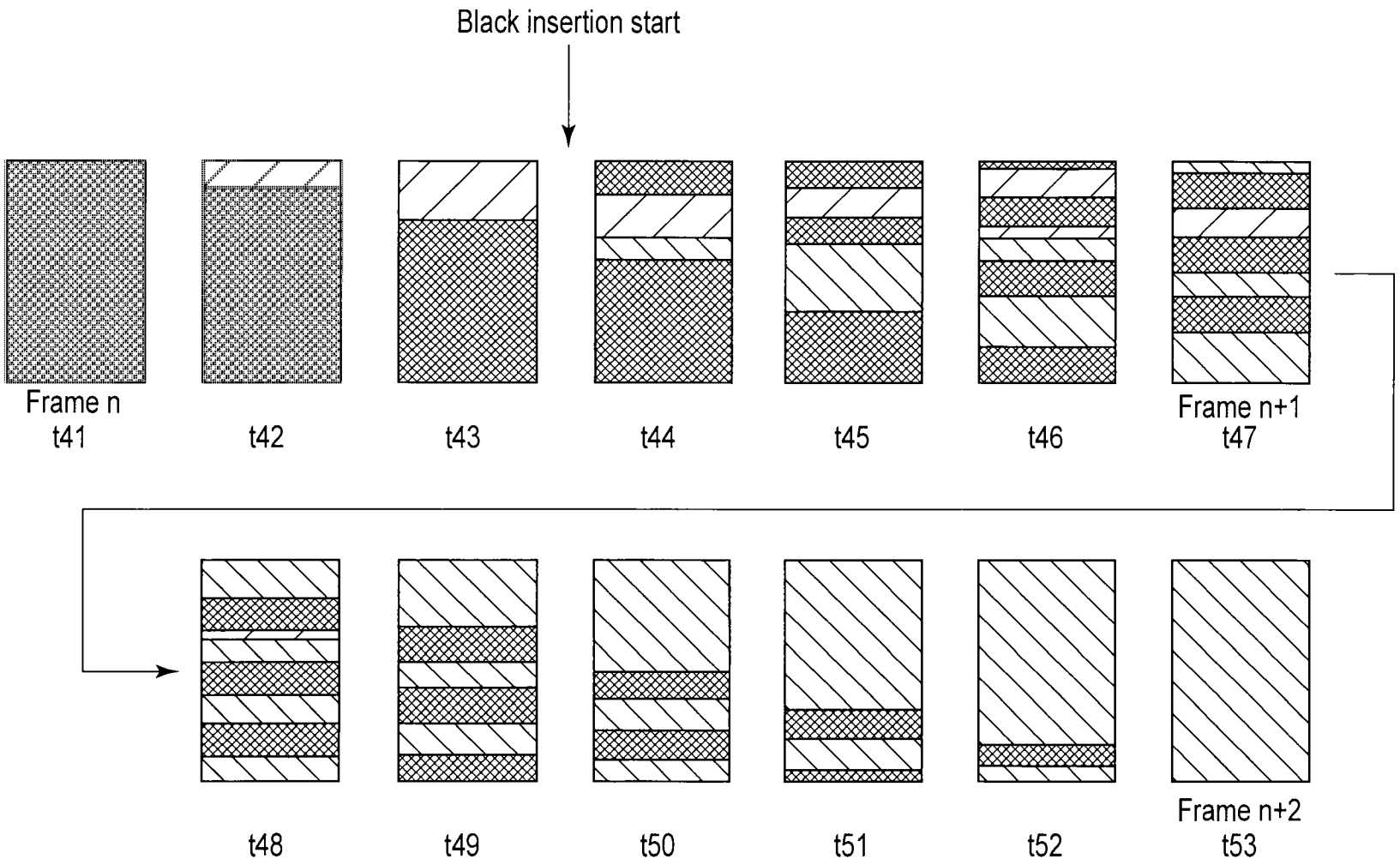
FIG. 18 is an exemplary view which is used to explain light emission time adjustment in the display device of the sixth embodiment.

FIG. 18 is another exemplary view which shows light emission time adjustment in the display device 10 of the sixth embodiment. FIG. 18 shows a time transition on a screen in which black frame continues until frame (n−1) and then yellow frame appears from frame n.

At time t41, when frame n starts, the screen is black. At time t42, a yellow image of frame n starts from the first line of the display area 3. Note that the luminosity of the yellow image of frame n is acquired based on a luminosity adjustment factor calculated based on black frame (n−1). At time t43, the display area of the yellow image of frame n extends. Between time t43 and time t44, the power consumption of frame n is determined to be beyond threshold Th1, and the black insertion is started.

At time t44, the yellow image display area extends downward and the black insertion area starts from the upper end of the screen extending downward. Here, the luminosity of the yellow image of the extending area is acquired by multiplying the current luminosity by an estimated luminosity adjustment factor of frame (n+1). Thus, the luminosity of the yellow image decreases. At time t45, the yellow image display area extends downward and the luminosity of frame showing yellow of lower luminosity (the shaded parts) is acquired by multiplying the current luminosity by the estimated luminosity adjustment factor of frame (n+1). Furthermore, following the black insertion area, the original yellow area starts from the upper end of the screen extending downward and a black insertion area starts from the upper end of the screen extending downward. At time t46, the condition of time t45 proceeds and the black insertion images and the yellow images are displayed alternately. At that time, the luminosity of the yellow image displayed in line positions on the screen is constant. That is, the luminosity of the yellow image displayed in the same line on the screen is the luminosity at time t45.

At time 47, the yellow image of the frame n reaches the lower end, frame n ends, and frame (n+1) starts. A yellow image of frame (n+1) starts from the first line of the display area 3. Here, the lower luminosity of the yellow image of frame n becomes substantially equal to the luminosity of the yellow image of frame (n+1). Note that the luminosity of frame (n+1) is acquired based on the luminosity adjustment factor calculated based on yellow frame n. From time t48 to time t52, the condition of time t47 proceeds. That is, a yellow and black stripe image moves downward while a yellow image of frame (n+1) extends downward from above. At time t53, the entire screen is covered with the yellow image of frame (n+1) and frame (n+2) starts.

If the same light emission period as that is used for the continuous black insertion operation is secured in the black insertion operation performed in a dividing manner, the black insertion operation is started relatively early. That is, unnecessary black insertion may be performed. Therefore, in the sixth embodiment, the start of the black insertion operation is unchanged while the power to be consumed in the last line is estimated from the start of the black insertion, and, using the luminosity adjustment factor obtained from a result of the estimation, the luminosity is decreased after the start of the black insertion operation in order to prevent display quality deterioration by flashing or the like.

Note that in each of the above embodiments, a calculation of power consumption has been performed in each line; however, no limitation is intended thereby. A calculation of power consumption may be performed in every several lines.

Furthermore, the technical concepts presented in the above embodiments are not limited to the use of the display device 10 using EL elements emitting light of RGB and may be applied to the use of a display device 10 using EL elements emitting white light and an RGB filter. The EL elements are not limited to organic EL elements and may be inorganic EL elements.

Any display device 10 which will be achieved by a person having ordinary skill in the art based on the display device 10 described as the embodiments with an arbitrary design change is in the scope of the present inventions without departing from the spirit of the inventions.

A person having ordinary skill in the art will conceive of various altercations and modifications within the technical scope of the present invention, and such altercations and modifications are encompassed by the scope of the present inventions. For example, the above embodiments with addition, deletion, and/or designed change of their structural elements by a person having ordinary skill in the art, or the above embodiments with addition, omission, and/or condition change of their processes by a person having ordinary skill in the art are encompassed by the scope of the present inventions without departing the spirit of the inventions.

Furthermore, other than the above advantages, advantages obviously achieved from the description of the present application, or advantages arbitrarily conceived by a person having ordinary skill in the art from the description of the present application are naturally acknowledged that they are achievable by the present inventions.

A suitable combination of the structural elements described in the above embodiments will achieve various inventions. For example, some structural elements may be deleted from the entire structural elements in the embodiments. Furthermore, structural elements described in different embodiments may be combined suitably.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A display device comprising:

a plurality of pixels each including a light emission element and a pixel circuit which supplies current to the light emission element; and a controller configured to generate image signals from display data, the image signals having luminosity which is less than or equal to luminosity of the display data, to supply the generated image signals to the pixels, and to execute black insertion, wherein a display pattern including at least three black belts structured by a plurality of continuing black display lines is synchronized with supply of the image signals and is displayed so as to move in the same direction of a screen scanning direction of the display panel during the black insertion, a total area of black belts displayed on a screen in one frame period varies, and after a lowest black display line of the black belts reaches an end portion of the screen of the display panel, the number of black belts continues to decrease.

2. A display device comprising:

a plurality of pixels each including a light emission element and a pixel circuit which supplies current to the light emission element; and a controller configured to generate image signals from display data, the image signals having luminosity which is less than or equal to luminosity of the display data, to supply the generated image signals to the pixels, and to execute black insertion, wherein a display pattern including a plurality of continuing black display lines is synchronized with supply of the image signals and is displayed so as to move in the same direction of a screen scanning direction of the display panel during the black insertion, the controller is configured to generate the image signals by multiplying the display data by a luminosity adjustment factor, and the luminosity adjustment factor is a positive real number which is less than or equal to one, and is acquired by substituting the power consumption of one previous frame calculated using the entire display data externally supplied to a decreasing function.

3. The display device according to claim 2, wherein the decreasing function F(x) results $F(x1) \geq F(x2)$ if $0<x1<x2$.

4. The display device according to claim 3, wherein the decreasing function F(x) results 1 if x< threshold Th2, and is a monotonous decreasing function if x> threshold Th2.

5. The display device according to claim 4, wherein the black display lines are obtained by stopping current supplied to the light emission elements on the lines.

6. The display device according to claim 4, wherein the image signals generated after the start of the black insertion are generated as a product of the display data externally supplied to each line and the luminosity adjustment factor acquired by substituting accumulated power consumption to the decreasing function, the accumulated power consumption being derived by accumulating the power consumption externally supplied to each line with respect to the display target frame until a current time point.

7. The display device according to claim 4, wherein the image signals generated after the start of the black insertion are generated as a product of the display data externally supplied to each line and the luminosity adjustment factor acquired by substituting whole power consumption of the display target frame to the decreasing function, the whole power consumption being estimated from accumulated power consumption derived by accumulating the power consumption externally supplied to each line with respect to the display target frame until a current time point.

8. The display device according to claim 3, wherein the black display lines are obtained by stopping current supplied to the light emission elements on the lines.

9. The display device according to claim 3, wherein the image signals generated after the start of the black insertion are generated as a product of the display data externally supplied to each line and the luminosity adjustment factor acquired by substituting accumulated power consumption to the decreasing function, the accumulated power consumption being derived by accumulating the power consumption externally supplied to each line with respect to the display target frame until a current time point.

10. The display device according to claim 3, wherein the image signals generated after the start of the black insertion are generated as a product of the display data externally supplied to each line and the luminosity adjustment factor acquired by substituting whole power consumption of the display target frame to the decreasing function, the whole power consumption being estimated from accumulated power consumption derived by accumulating the power consumption externally supplied to each line with respect to the display target frame until a current time point.

11. The display device according to claim 10, wherein the image signals generated after the start of the black insertion are generated as a product of the display data externally supplied to each line and the luminosity adjustment factor acquired by substituting accumulated power consumption to the decreasing function, the accumulated power consumption being derived by accumulating the power consumption externally supplied to each line with respect to the display target frame until a current time point.

12. The display device according to claim 2, wherein, in the display pattern of the black insertion, continuing black display lines are displayed repeatedly with certain intervals.

13. The display device according to claim 12, wherein the black display lines are obtained by stopping current supplied to the light emission elements on the lines.

14. The display device according to claim 12, wherein the image signals generated after the start of the black insertion are generated as a product of the display data externally supplied to each line and the luminosity adjustment factor acquired by substituting whole power consumption of the display target frame to the decreasing function, the whole power consumption being estimated from accumulated power consumption derived by accumulating the power consumption externally supplied to each line with respect to the display target frame until a current time point.

15. The display device according to claim 2, wherein the black display lines are obtained by stopping current supplied to the light emission elements on the lines.

16. The display device according to claim 15, wherein the image signals generated after the start of the black insertion are generated as a product of the display data externally supplied to each line and the luminosity adjustment factor acquired by substituting accumulated power consumption to the decreasing function, the accumulated power consumption being derived by accumulating the power consumption externally supplied to each line with respect to the display target frame until a current time point.

17. The display device according to claim 15, wherein the image signals generated after the start of the black insertion are generated as a product of the display data externally supplied to each line and the luminosity adjustment factor acquired by substituting whole power consumption of the display target frame to the decreasing function, the whole power consumption being estimated from accumulated power consumption derived by accumulating the power consumption externally supplied to each line with respect to the display target frame until a current time point.

18. The display device according to claim 2, wherein the image signals generated after the start of the black insertion are generated as a product of the display data externally supplied to each line and the luminosity adjustment factor acquired by substituting accumulated power consumption to the decreasing function, the accumulated power consumption being derived by accumulating the power consumption externally supplied to each line with respect to the display target frame until a current time point.

19. The display device according to claim 2, wherein the image signals generated after the start of the black insertion are generated as a product of the display data externally supplied to each line and the luminosity adjustment factor acquired by substituting whole power consumption of the display target frame to the decreasing function, the whole power consumption being estimated from accumulated power consumption derived by accumulating the power consumption externally supplied to each line with respect to the display target frame until a current time point.

20. A display device comprising:

a plurality of pixels each including a light emission element and a pixel circuit which supplies current to the light emission element to display a display pattern on the display device, wherein the display device is configured to generate image signals from display data, the image signals having luminosity which is less than or equal to luminosity of the display data, to supply the generated image signals to the pixels, and to execute black insertion, the display pattern includes at least three black belts structured by a plurality of continuing black display lines that is synchronized with supply of the image signals and is displayed so as to move in the same direction of a screen scanning direction of the display panel during the black insertion, a total area of black belts displayed on a screen in one frame period varies, and after a lowest black display line of the black belts reaches an end portion of the screen of the display panel, the number of black belts continues to decrease.

* * * * *